US005785153A

United States Patent [19]

Powell et al.

[11] Patent Number: 5,785,153

[45] Date of Patent: Jul. 28, 1998

[54] SYNCHRONIZING ELEVATOR ARRIVAL AT A LEVEL OF A BUILDING

[75] Inventors: Bruce A. Powell, Canton; Joseph Bittar, Avon; Frederick H. Barker, Bristol; Samuel C. Wan, Simsbury; Paul Bennett, Waterbury; Anthony Cooney, Unionville; Richard C. McCarthy, Simsbury, all of Conn.; John K. Salmon, deceased, late of Southwindsor, Conn., by Lucymary Salmon, legal representative

[73] Assignee: Otis Elevator Company, Farmington, Conn.

[21] Appl. No.: 666,181

[22] Filed: Jun. 19, 1996

Related U.S. Application Data

[63] Continuation-in-part of Ser. No. 564,703, Nov. 29, 1995, Pat. No. 5,660,249.

[51] Int. Cl.[6] ..... B66B 9/00

[52] U.S. Cl. ..... 187/249

[58] Field of Search ..... 187/239, 249, 187/410, 256; 182/12–14

[56] References Cited

U.S. PATENT DOCUMENTS 5,090,515 2/1992 Takahoshi et al. ..... 187/249

*Primary Examiner*—Kenneth Noland

[57] ABSTRACT

The arrival of each of four dual-hoistway shuttle elevators S1–S4 is synchronized with a selected one of ten local elevators L1–L10, or ten low rise elevators L1–L10 and ten high rise elevators H1–H10 at a transfer floor 26 by limiting 140 the speed of the shuttle, gradually 149, or rapidly 154, 155 decreasing the speed of the shuttle, delaying a local elevator by holding its doors open for extra time, or controlling the speed of a local elevator, by cancelling or avoiding hall calls. Empty local elevators may be allowed to remain at the high end of the building, or compelled to travel to the lobby if needed. Elevators approaching a transfer floor may be synchronized by adjusting the speed of one of them until the remaining distance is the same for both. Hall calls may be prevented, cancelled, or negatively biased in dependence upon the tardiness of a local elevator. Synchronization may be achieved between shuttle elevators and local elevators, between portions of multi-hoistway shuttle elevators, and amongst elevator combinations employing three or more hoistways.

27 Claims, 15 Drawing Sheets

B
C
D
23
24
A-TWO
21
A-ONE
22
24

L1
L2
L3
L4
L5
L6
L7
L8
L9
L10
Y9
X1
Y10
X2
Y1
Y2
26
S1
S2
S3
S4

30
350
29
27
28
LOBBY

FIG.5
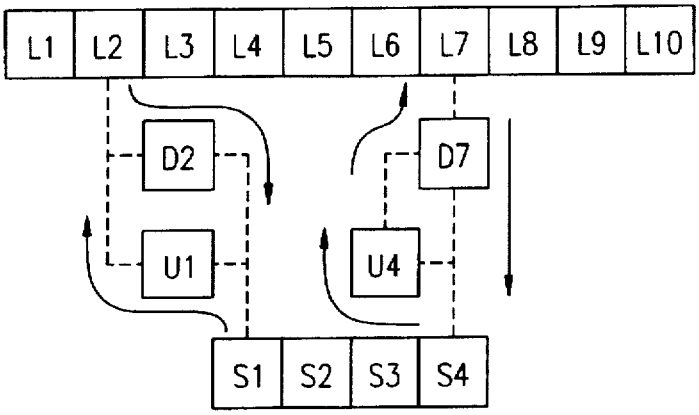
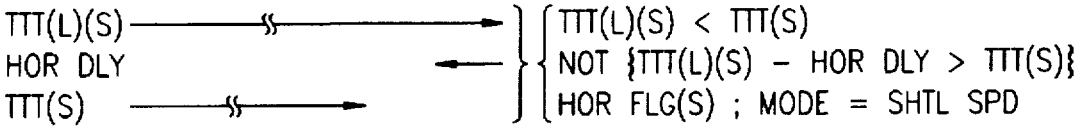
FIG.6
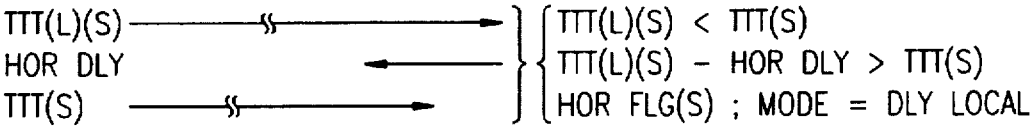
FIG.7
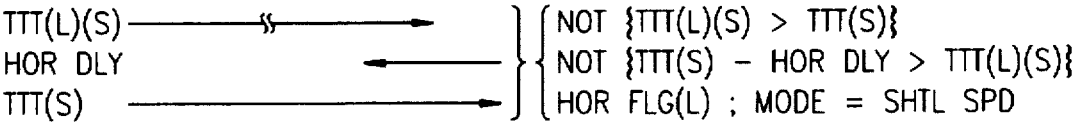
FIG.8
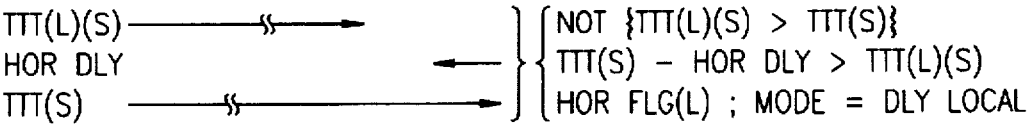
FIG.9

FIG.19
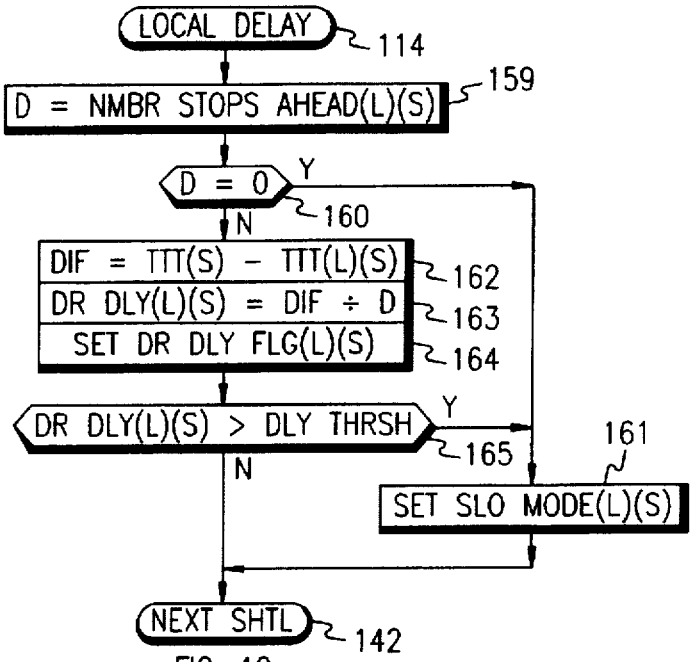
FIG. 10
FIG.22
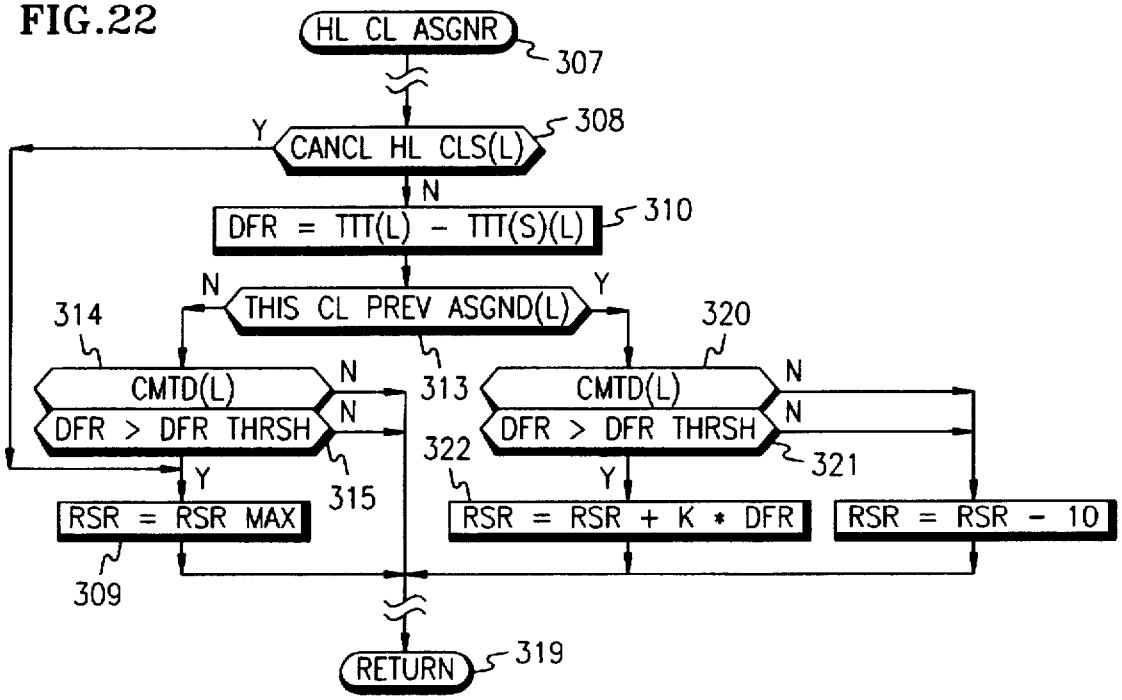

SYNCHRONIZING ELEVATOR ARRIVAL AT A LEVEL OF A BUILDING

CROSS REFERENCE TO RELATED APPLICATIONS

This application is a continuation in part of U.S. patent application Ser. No. 08/564,703, filed on Nov. 29, 1995 now U.S. Pat. No. 5,660,249.

TECHNICAL FIELD

This invention relates to timing the arrival of a lower elevator car frame with that of an upper elevator car frame among which elevator cabs are to be transferred at a transfer floor.

BACKGROUND ART

In order to extend the useful height of roped elevator systems in very tall buildings, and to utilize each elevator hoistway more effectively in carrying passengers, a recent innovation is transferring a cab between overlapping elevator shafts, and more particularly, exchanging a pair of cabs between elevator shafts. Such a system is disclosed in the aforementioned parent application hereof. When the closing of elevator car doors is left up to passengers, as in conventional elevator systems, and when the final closing of the door signals the start of an elevator trip, the timing of the elevator trip cannot be well controlled. On the other hand, when passengers are unloaded from and loaded into elevator cabs as they stand at a landing off the elevator hoistway, the elevator cab doors can be closed in advance of the beginning of the trip, whereby the trip can be synchronized carefully with another, similarly operated elevator among which the cabs are to be exchanged.

The exchange of cabs between hoistways has thus far been disclosed only among shuttle elevators, that is, elevators that take passengers from a first major floor to a second major floor, with no choice of stops in between. Shuttles can be resynchronized together each time that a pair of them leave opposite landings to head for a common transfer floor. In such a case, small variations may be easily accommodated.

DISCLOSURE OF INVENTION

Objects of the invention include synchronizing the arrival time of a plurality of elevators at a building level (such as at a transfer floor so that exchanges of cabs may be made between the elevators without causing the passengers to wait in a static elevator cab at the building level for an undue amount of time) selecting elevators to have their arrival at a common building level mutually synchronized; and exchanging cabs between local elevators, such as may exist on the top of a very tall building, and elevator shuttles, such as may feed the local elevators from the lowermost floors, without undue delay.

According to the present invention, the operation of elevators is adjusted so as to cause them to arrive at a given level of a building, such as a transfer floor, more nearly at the same time as one or more other elevators (such as so that a cab may be exchanged between them with a minimum of passenger waiting time at the transfer floor). According to the invention in one form, the speed of the elevator closest to the transfer floor is decremented by an amount proportional to the difference in the distance that each elevator is from the transfer floor. According to the invention in another form, the motion of an elevator that is determined to have the lesser time remaining to reach a transfer floor is adjusted in a manner to tend to cause it to arrive more nearly at the same time with another elevator, such as one with which it will exchange one or more cabs. In accordance with this aspect of the invention, an elevator car may be accelerated only to an average speed that will cause the timing to be correct, or it may be slowly decelerated from its current speed to a second speed, the average of which during deceleration will cause the timing to be correct, or it may be immediately decelerated to very slow speed, which will help to cause the two elevators to arrive at the meeting floor level more nearly at the same time.

In still further accord with the present invention, the time of arrival of a local elevator to a building level, such as a transfer floor, may be delayed by adding an increment of fixed delay to the door open time at each stop, whereby passengers are caused to wait during door open conditions, rather than being caused to wait while the car is static with the doors closed. In further accord with the invention, a local elevator may have its estimated remaining time to a building level, such as a transfer floor, checked at the last stop that it will make, and its doors may be held open until the time remaining to the building level is sufficiently close to the time remaining for another elevator, with which it is to be synchronized, such as for exchanging a cab, to reach the building level.

In still further accord with the present invention, hall calls can be blocked from being assigned to a local elevator which is tardy in meeting the arrival time of another elevator with which it is to exchange a cab at a transfer floor, to hasten the car's arrival at the floor. In further accord with the invention, hall calls assigned to a car which is tardy in reaching a building level in synchronism with another car may be reassigned as a balanced function of the superiority of the assignment versus the degree of tardiness of the car, to hasten the car's arrival. In still further accord with the invention, combinations of the foregoing may be utilized to tend to bring elevators to a meeting floor at nearly the same time.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 5 is a simplified plan view of the transfer floor of FIG. 2.

FIGS. 6–9 are diagrammatic illustrations of differences in arrival times between a shuttle and a local car in contrast with delay times at the transfer floor.

FIGS. 10, 18 and 19 together comprise a logic flow diagram of a synchronizing routine, in which FIG. 10 is a subroutine for selecting the synchronization mode. FIG. 18 is a subroutine for controlling shuttle speed to achieve synchronization, and FIG. 19 is a subroutine which delays the local car to achieve synchronization.

FIG. 22 is a logic flow diagram of a portion of a hall call assignor routine in which the assignment of hall calls can be altered, to hasten the local car, in dependence upon a committed car being tardy in reaching a transfer floor.

BEST MODE FOR CARRYING OUT THE INVENTION

Figure 1:
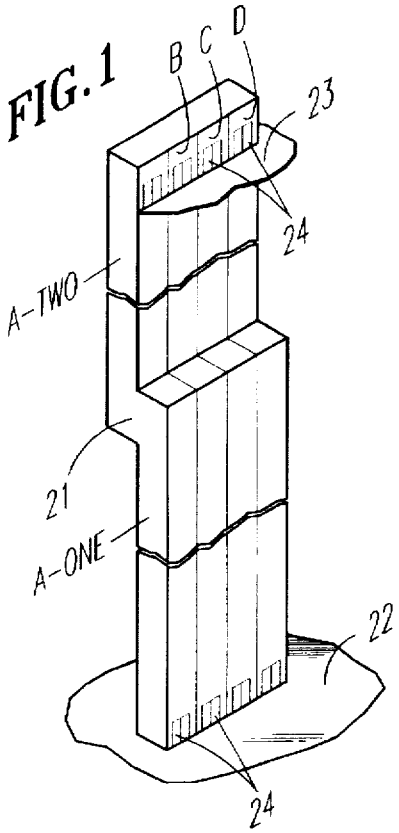
FIG. 1 is a simplified, stylized view of a bank of simple, two-shaft elevator shuttles which may be synchronized by the present invention.

FIG. 1 illustrates a bank of elevator shuttles A–D, each having a low elevator, designated ONE, overlapping with a high elevator, designated TWO. In each shuttle, elevator ONE overlaps with elevator TWO and a pair of cars are exchanged between upper and lower decks of the two elevators at a transfer floor 21, as in the parent application. In the embodiment of FIG. 1, it is assumed that elevator cars stand at the lobby landings 22, 23 with the doors 24 open for passenger unloading and loading. In this type of shuttle, passengers typically control the time during which the doors are held open, by means of the door open button and/or the between-door safety devices. When doors are closed for both the lower elevator and the upper elevator, they can be dispatched in a synchronized fashion and presumably arrive at the transfer floor 21 at essentially the same time. However, due to variations in elevator machines with different loadings, that time might not be as close as desired. Therefore, one embodiment of the invention (illustrated in FIG. 21) is suited to make minor adjustments in the speed of one of the elevators so they will arrive more nearly at the same time at the transfer floor 21.

Figure 2:
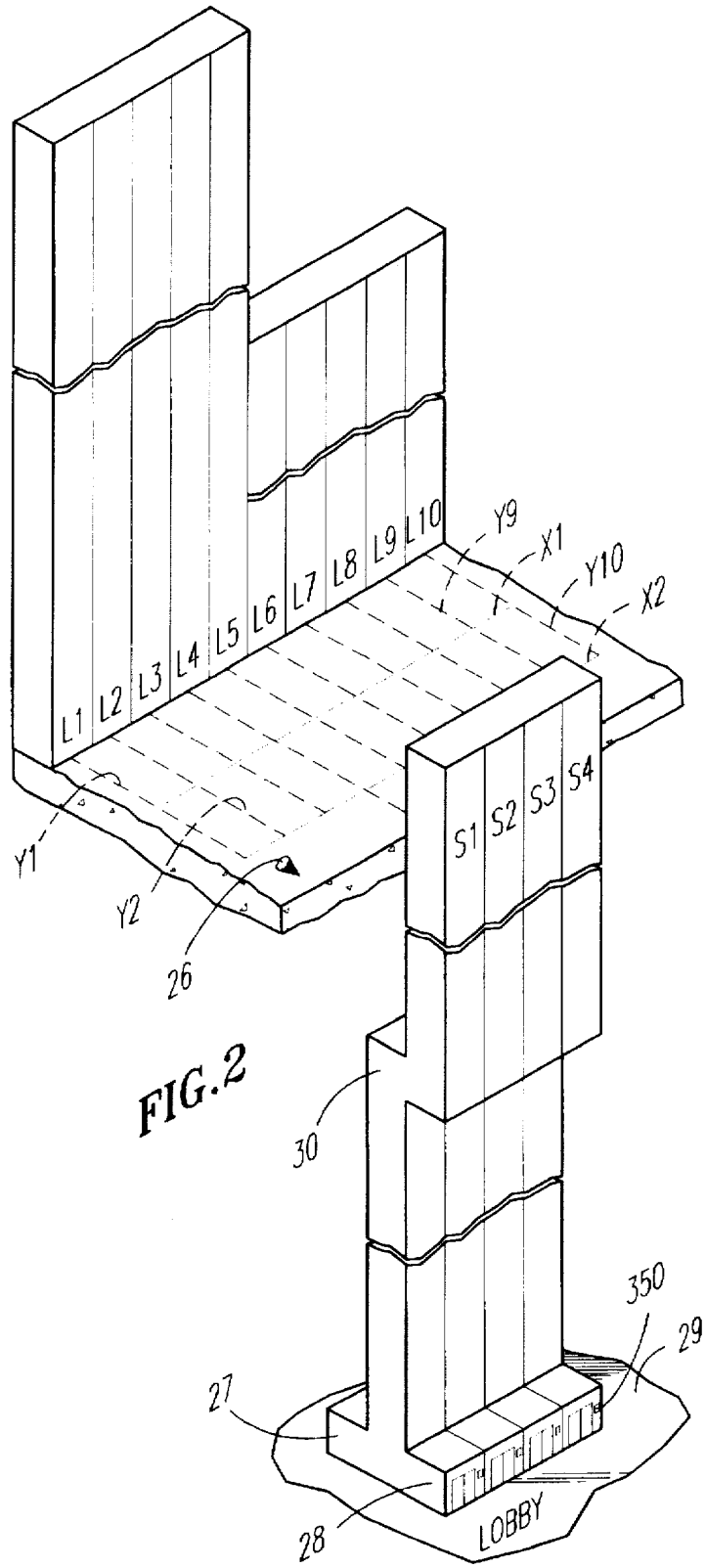
FIG. 2 is a simplified, stylized, perspective view of a bank of two-shaft elevator shuttle systems with off-shaft loading and unloading, serving a larger bank of local elevators at the high end of a building, which may be synchronized in a variety of ways in accordance with the present invention.

Referring now to FIG. 2, a far more complex elevator installation comprises a plurality of elevator shuttles S1–S4 which exchange cabs with a plurality of local elevators L1–L10 at a transfer floor 26. In the general embodiment of FIG. 2, the local elevators may all be low rise, with no express zones, or some, such as L1–L5 or more, or all, might be high rise having express zones below the floor landings served thereby, in the conventional fashion. That is irrelevant to the invention, as can be seen in the following description. In the following description, it is assumed all of the locals L1–L10 in FIG. 2 are either high rise or low rise; the case for some being high rise and some being low rise in FIG. 2 is discussed hereinafter with respect to FIG. 28. The shuttles in this embodiment are depicted as being of the type where cabs are placed at landings 27, 28, alternatively, at a lobby floor 29 for loading and unloading of passengers. In a case such as this, the car doors can be commanded to close at a time before the arrival of the car frame on which the car will be loaded, so typically the dispatching can be quite precisely controlled. In such a case, dispatching from the lobby 29 would be simple except for the fact that the car frame in the lower leg of a shuttle S1–S4 leaving the lobby 29 will want to reach a transfer floor 30 at the same time as a car frame in the upper leg of the shuttle, and the car frame leaving the transfer floor 26 will be scheduled to do so as soon as a cab is loaded on the car frame from one of the local elevators L1–L10. For this reason, the dispatching of car frames from the lobby 29 might indeed be controlled by the loading of a cab onto the related elevator car frame at the transfer floor 26.

On the other hand, in the embodiment of FIG. 2 there are advantageously a plurality of local elevators, principally because local elevators consume far greater amount of time than shuttle elevators to complete a round trip run, and that timing is truly random and sporadic. Therefore, it is possible to dispatch elevators from the lobby 29 without regard to the inflow of cabs at the transfer floor 26, selecting a local elevator with which to exchange cabs after a shuttle has left the lobby 29.

The transfer floor 26 is assumed to be of the type described in the commonly owned U.S. patent application Ser. No. 08/666,162 filed Jun. 19, 1996. It includes a pair of linear induction motor (LIM) paths X1, X2 in a first (X) direction and a plurality of LIM paths Y1, Y2, . . . Y9 and Y10 orthogonal to the X paths. The dash lines in FIG. 2 denote the center of each path, which also comprises the positioning of the LIM primary on the transfer floor 26, used as motivation for a pair of cab carriers to transfer a cab from one of the local elevators L1–L10 to one of the shuttles S1–S4, simultaneously with transferring another one of the elevator cabs from one of the shuttles S1–S4 to the same one of the local elevators L1–L10 which is transferring a cab thereto. There may be a pair of tracks for guiding the wheels of a cab carrier associated with each of the paths X1, X2, Y1–Y10.

The present invention, however, is not concerned with the manner in which cabs are moved from one elevator to another, but rather with controlling the motion of them so that they arrive at the transfer landing 21, 30 or 26 at as nearly as possible simultaneously.

Figure 3:
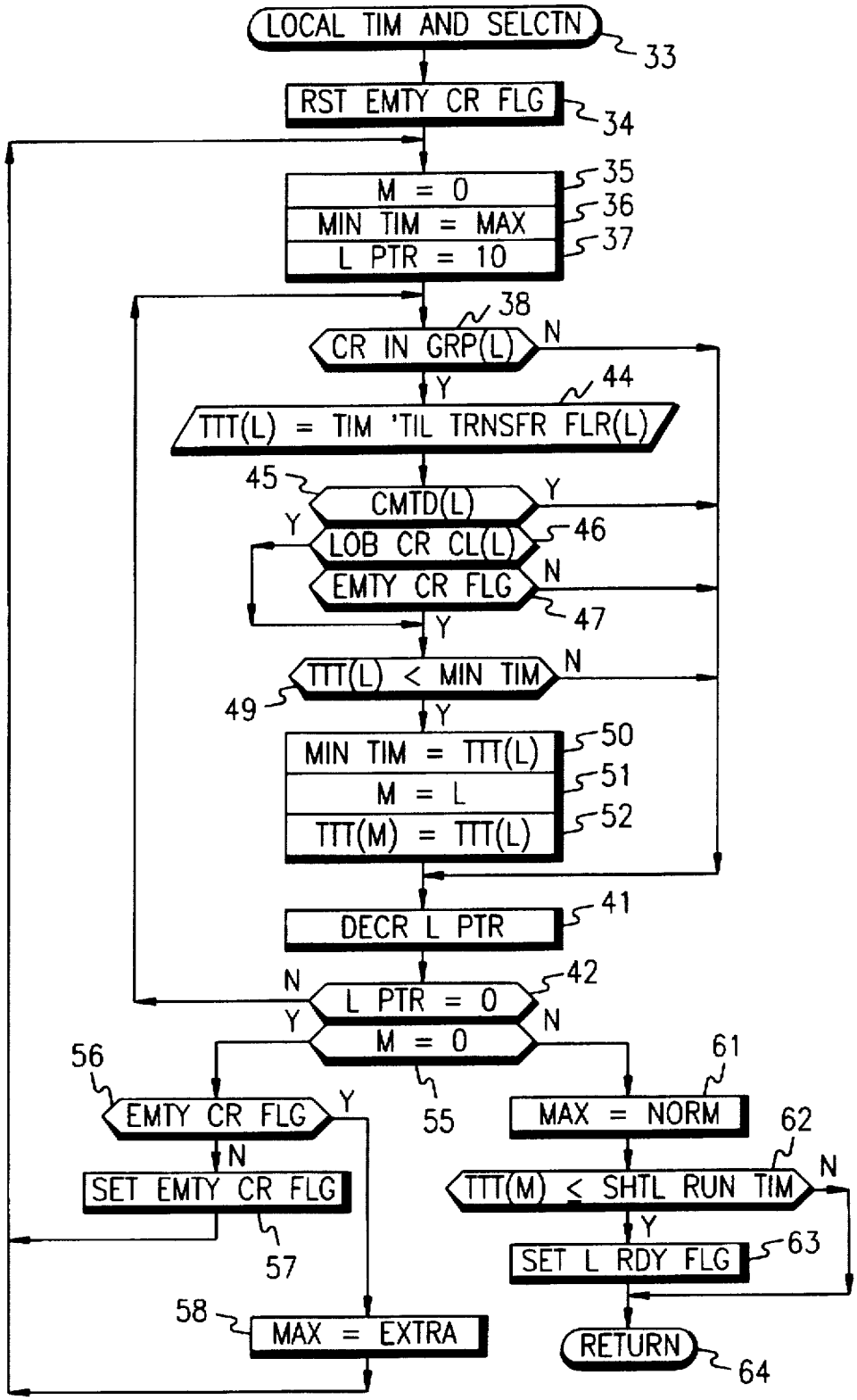
FIG. 3 is a logic flow diagram for determining the time until local cars will reach a transfer floor and picking the next local car to exchange a cab with a shuttle based thereon.

An embodiment of the invention, with variants therein, useful in synchronizing the shuttles S1–S4 with the local elevators L1–L10 of FIG. 2, utilizes a Local Time and Selection routine of FIG. 3 which is reached through an entry point 33. A first step 34 resets an empty car flag which is used only in this routine in a manner described hereinafter. Then a plurality of steps 35–37 initialize the process by setting a designator, M, to zero, setting a minimum time (tested for, during the routine) to a maximum amount of time, and setting an L pointer (which points successively to each of the local elevators in turn) to the highest elevator, 10. The maximum time set in step 36 might be, for instance, on the order of halfway between the fastest shuttle run time and the slowest shuttle run time, as described more fully hereinafter. Then, a test 38 determines if the car designated by the L pointer has its car in group flag set or not. If not, the car is not available for assignment to exchange a cab with a shuttle elevator, so it is bypassed; a negative result of test 38 reaching a step 41 to decrement the L pointer thereby to designate the next local elevator in turn. Then a test 42 determines if all the cars have been tested, as will be the case when the L pointer is decremented to zero. If not, a negative result of test 42 reverts the program to test 38 to determine if the next car (car L9 in this case) is in the group, or not.

Assuming that it is, an affirmative result of test 38 reaches a subroutine 44 to calculate the "time 'till transfer floor" (TTT) for car L. This is the calculation frequently referred to as RRT (remaining response time) or the like, which simply considers the number of floors to be traversed, whether they will be traversed one floor at a time or at higher speeds between multiple floors, door opening and closing times, times for boarding and deboarding hall and car passengers, and the like. All this is extremely well known and not detailed further herein. Once TTT for car L has been calculated, the test 45 determines if car L is already committed to one of the shuttles or not. In this routine, the TTT for each car that is in the group is calculated every time the program passes through the routine of FIG. 3. But, the determination of a car with the lowest TTT is only performed with those local cars available to become assigned to one of the shuttles. If the car is previously committed, it is no longer available for such a commitment and therefore a negative result of test 45 causes the program to advance to the step 41 and test 42 to consider the next car in turn. If the car under consideration has not yet been committed, a negative result of test 45 reaches a test 46 to determine if the car under consideration has a lobby car call or not. If it does, then presumably there is a passenger which requires travel to the lobby and therefore this cab must be transferred to a shuttle (see FIG. 2) for downward travel to the lobby. On the other hand, if there is no one in the cab desiring to go to the lobby, this car can remain in the upper floors to perform local traffic service among the upper floors. So if there is no lobby car call, a negative result of test 46 reaches a test 47 to determine if the empty car flag has been set or not. The purpose of this flag is to identify the fact that no car is able to be selected, and the selection process should be repeated using all the cars in the group, even those without a lobby call, to see if a suitable car can be selected, as is described more fully hereinafter. If test 46 is negative indicating that the car does not have a lobby call and the empty car flag has not yet been set, a negative result of test 47 causes the step 41 and test 42 to cause the program to revert for the next car in turn.

Assume for the moment that the car under consideration has a car call for the lobby, an affirmative result of test 46 reaches a test 49 to determine if the TTT for the car under consideration is less than MIN time. For the first car reaching this test, the comparison is made with the MIN time established as maximum in step 36. For subsequent cars, the MIN time will be the lowest one selected heretofore. If the TTT for the car under consideration is not less than MIN time, a negative result of test 49 causes the step 41 and test 42 to cause the program to reach the next car in turn. But if test 49 is affirmative, the MIN time is updated to be equal to TTT for this car, L, a designated car to be matched with a shuttle, M, is set equal to L, and the TTT for the designated matched car is set equal to the TTT for this car, L. These steps define the next car which will become committed to a shuttle and its current time estimated to reach the transfer floor.

When all ten cars have been tested, test 42 will be affirmative reaching a test 55 to determine if M is still zero. If it is, this means that none of the cars has had a TTT less than the original MIN time set to be equal to MAX. If the maximum value of MIN time is established to be some median value such as between the minimum time required for a normal shuttle run and the maximum time that a shuttle can be allowed to take in making its run, an affirmative result of test 55 will simply indicate that a good selection has not been made. With or without knowing whether there is an empty car, an affirmative result of test 55 will reach a test 56 to determine if the empty car flag is set or not. In the first pass through test 56, it will not be set because it is reset in step 34. Therefore, a negative result reaches a step 57 to set the empty car flag. Then, the program reverts to tests 35–37 to repeat the process for all ten cars. If in this pass through the routine of FIG. 3 one of the cars does not have a lobby call, nonetheless this time test 47 will be affirmative because the empty car flag is set and therefore this car can be included in the calculation. Even though there is no lobby call, the car still may have numerous calls and therefore may not be a good candidate, but on the other hand, it may be. In any event, the process is repeated for all ten cars and if, at the end, test 55 indicates that N is still zero, meaning no car was selected with a MIN time less than MAX (set in step 36 and tested in test 49) an affirmative result of test 55 this time will reach an affirmative result of test 56 since the empty car flag has been set. This will reach a step 58 to change the maximum value to an extra, higher value, which might be the maximum amount of time that a shuttle can be caused to take to make a run when it is slowed down completely. Or it could be some other time. With MAX having been adjusted, then the process reverts to the steps 35–37 and is repeated again for all ten cars. Presumably, a match will now be made so that M is no longer zero and test 55 will be negative. When that happens, a step 61 restores MAX to the normal value and a test 62 determines if the selected TTT for the matched car is equal to or less than a normal shuttle run time. If it is, a step 63 sets an L ready flag, indicating that there is a local car which can easily meet with a shuttle if the shuttle is dispatched in the very near future. But if the TTT for the selected car is greater than a normal shuttle run time, test 62 is negative and the local ready flag is not set in step 63. Thereafter, other programming is reverted to by the controller through a return point 64.

The program of FIG. 3 is run repetitively, many times each second. Therefore, there is always a car ready to be matched with a shuttle (if one is available) and the estimated time it will take each of the cars to reach the transfer floor is reestimated in each pass through the routine of FIG. 3. This makes it possible for shuttles to be matched to selected local cars, either in the process of becoming dispatched, in one embodiment, or after being dispatched, in another embodiment. It also allows continuous, periodic adjustment of the processes used hereinafter to synchronize the local cars and shuttles, as they approach the transfer floor.

Figure 4:
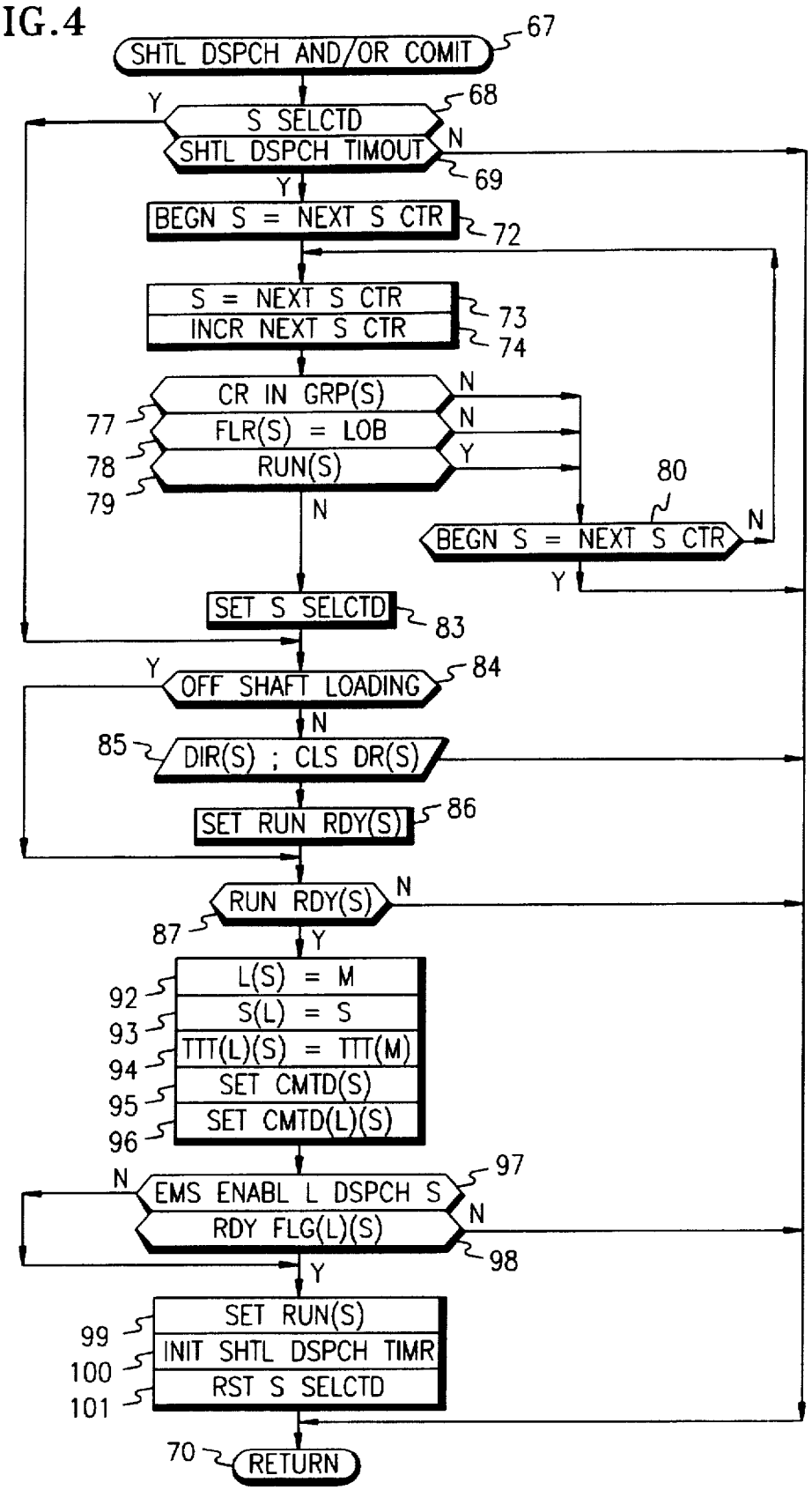
FIG. 4 is a logic flow diagram of a routine for dispatching a shuttle and/or for selecting a shuttle for commitment to a particular local car for the exchange of cabs.

In this embodiment, whenever a shuttle is ready to be matched up with a local car, so that the two may exchange cabs at the transfer floor 26, the shuttle will align itself with that local elevator which has been designated M by the process of FIG. 3. In FIG. 4, a Shuttle Dispatch and/or Commitment routine is reached through an entry point 67 and a first test 68 determines if a shuttle has been selected, or not. A shuttle will be deemed to have been selected once it is paired up with a local elevator and until it leaves the lower lobby 29. Thereafter, each shuttle and local elevator combination that have been paired together will work out their synchronization until they reach the transfer floor 26. In the initial description of FIG. 4, it will be assumed that there is a single shuttle elevator extending all the way from the lobby 29 to the transfer floor 26; this assumption is equally valid for a case where there are two overlapped elevators in each shuttle, as shown in FIG. 2, but they are treated as one; that is to say, the overall distance is essentially twice the distance of one of them and the time for transfer at the transfer floor 30 is figured in to the calculations (not shown). Various ways of accommodating multi-elevator shuttles are described hereinafter.

In FIG. 4, assume that there is no shuttle which has been selected but is not yet set to run. In such a case, a negative result of test 68 reaches a test 69 to see if the shuttle dispatch timer has timed out yet, or not. Much of the time, test 69 will be negative, so the remainder of FIG. 4 is bypassed and other programming is reverted to through a return point 70. Eventually, in a subsequent pass through FIG. 4, when the shuttle dispatch timer has timed out, an affirmative result of test 69 will reach a step 72 which sets a beginning S value equal to a value set in a next S counter. The next S counter just keeps track of which shuttle's turn it is to make a round trip. The beginning S value keeps track of where this counter was at the start of the process, as described more fully hereinafter. Then a step 73 sets a value, S, equal to the next S counter, to designate the shuttle to be worked with in this process. A step 74 increments the S counter to point to the next one of the shuttles in turn. A step 77 determines if shuttle S is in the group, and if it is, a test 78 determines if the floor for shuttle S is the lobby floor 29, and if it is, a step 79 determines if shuttle S is in the running condition, or not. If either the shuttle is not in the group, the shuttle is not at the lobby or the shuttle is already in a running condition, then results of tests 77–79 will reach a test 80 to see if the beginning S value is set equal to the current setting of the next S counter. If it is, this means that each of the shuttles have been tested and failed, so there is no point in continuing to lock the program up testing shuttles. Therefore, an affirmative result of test 80 will cause other programming to be reached through a return point 70. On the other hand, during a first few attempts to select a shuttle which may have failed, the beginning S value will not equal the next S counter so a negative result of test 80 will cause the program to revert to the steps 73 and 74 to run the process for the next shuttle in turn. But assuming that the shuttle designated by the S counter is available, a negative result of test 79 will reach a step 83 to set a flag, indicating in subsequent passes through the routine of FIG. 4 that the shuttle S has been selected for use.

What happens next depends upon the nature of the system in which the invention is used. If the invention is being used in a system as in FIG. 2, in which passengers are loaded and unloaded off-shaft, and the opening and closing of the cab doors are controlled by the cab and the landing, rather than by the elevator car itself, then an affirmative result of a test 84 will bypass a routine 85 that might be utilized in the embodiment of FIG. 1. In the embodiment of FIG. 1, when it is time for a shuttle to close its doors and begin a trip, a direction routine to establish the up direction of travel for the elevator car frame and to close the doors of the cab might be utilized. During that process, while things are happening, other programming will be reached many times through the return point 70. Eventually, when direction has been set and the doors are fully closed, the routine will set run ready for that shuttle in a step 86. In the embodiment of FIG. 2, when a cab is ready to be loaded onto a shuttle car frame simultaneously with off-loading a cab from the car frame, a run ready is provided. Thus in either case, whether the cab is loaded on the car frame as in FIG. 1 or at a landing off the hoistway as in FIG. 2, when the cab is ready, a run ready signal will be present for the shuttle S. Therefore, a test 87 will be affirmative reaching a series of steps 92–99. The first two steps 92, 93 commit the particular local car L and the particular shuttle S to each other by causing L of S to be set equal to M (the local elevator determined in FIG. 3 to be ready to be matched with a shuttle), and S of L equal to S, the shuttle designated by the next S counter in step 73 hereinbefore. Then, TTT for the local assigned to shuttle S is set equal to TTT of the selected car M (that is, the value established in step 52 of FIG. 3). Then the steps 95 and 96 set flags indicating that shuttle S and local car L are both now committed and cannot be further assigned. A test 97 determines whether the particular embodiment of the invention is one in which the elevator management system (EMS), or other control, has enabled a feature that allows the local car, which has been matched with this particular shuttle, to determine when this particular shuttle will be dispatched. If the feature is available, then an affirmative result of test 97 will reach a test 98 to see if the local car is ready or not. If the feature is not available, a negative result of test 97 bypasses the test 98. If either the feature is not used or the local car is ready to travel, a negative result of test 97 or an affirmative result of test 98 will reach a step 99 in which shuttle S is set to run. This causes the commencement of a trip upward through the hoistway toward the transfer floor 26 under control of a motion controller in the well-known fashion. The motion control and the transfer from the lower hoistway to the upper hoistway of the particular shuttle involved all can be accomplished in the fashion set forth in the parent application. Then a step 100 initializes the shuttle dispatch timer so as to create the proper interval from this shuttle trip to the next one, and a step 101 resets the S selected flag which was previously set in step 83 with respect to this shuttle.

In the routines of FIGS. 3 and 4, it is seen that FIG. 3 always is identifying a suitable local car to be matched up with a shuttle and FIG. 4 picks the next shuttle and then accepts that match up. In FIGS. 5–9 there is described the delay which can be caused when a local car, such as L7, is assigned to the car directly across from it, such as S4. In every other situation, as illustrated in FIG. 5, whenever cars that are not opposite each other are assigned to each other, the length of time that it takes one cab to travel from a local to a shuttle is the same as it takes for the other cab to travel from shuttle to the local. Thus in FIG. 5, an up car, designated U1, has been brought up on shuttle S1 and is now traveling toward local L2 at the same time that a down traveling cab, designated D2 in FIG. 5 has begun traveling from local elevator L2 to shuttle S1. It is apparent by inspection that the length of the two trips are the same. However, in the case of an up cab from shuttle S4, designated U4 in FIG. 5, being exchanged with a down cab, designated D7, from local elevator 7, one of the cabs has to get out of the way of the other. Of course, each could get out of the way and then the length of travel would be the same. That is, if D7 traveled to the right to the track Y9 (see FIG. 2) before traveling toward track X2, it would have the same trip as the trip shown in FIG. 5 for the up traveling car U4. However, this would cause one set of passengers to be in a horizontally moving cab longer than absolutely necessary, and that may be desired to be avoided. If that is the case, it is possible to allow the up traveling cab U4 to reach the transfer floor sooner and begin its trip before the down traveling cab D7 actually gets to the transfer floor 26 so that the down traveling cab D7 can immediately leave local elevator L7 and head straight across for shuttle S4. In such a case, the synchronizing will take into account the fact that cab U4 can get to the transfer floor 26 ahead of cab D7. Of course, the converse is also possible; FIGS. 6–9 express the different possibilities.

In FIG. 6, the situation is that the time 'till transfer floor (TTT) for the local car assigned to the shuttle in question (as defined hereinafter) is greater by more than a horizontal delay difference than the TTT for the shuttle in question. In such a circumstance, a horizontal flag for shuttle S is set indicating that the cab from the shuttle will take the long route and allow the cab from the local take the short route. Additionally, the mode selected to do the synchronizing is: control over the speed of the shuttle, because the shuttle will get to the transfer floor at a point in time earlier than the local by more than the horizontal delay time for allowing the cab to get out of the way of the other cab (U4 in FIG. 5).

In FIG. 7, the time remaining for the local to reach the transfer floor is greater than the time remaining for the shuttle to reach the transfer floor, so the horizontal flag is set for the shuttle as before: however, the local will get to the transfer floor before the shuttle cab is out of the way (in track Y6 as seen in FIG. 5) unless it is slowed down. Therefore, the synchronizing mode is to delay the local.

In FIG. 8, TTT for the local is less than TTT for the shuttle but is not less than TTT for the shuttle minus the horizontal delay. Therefore, the local cab is caused to take the long route and get out of the way of the shuttle cab, but thereafter, it will not get to the transfer floor sufficiently ahead of the shuttle cab to allow the local cab to get out of the way first. Therefore, the shuttle speed has to be slowed down to provide some additional delay, and that is the mode that is selected.

In FIG. 9, the shuttle TTT is larger than the TTT for the local assigned to the shuttle, by more than the horizontal delay. Therefore, the local cab is caused to take the long route and get out of the way of the shuttle cab, and the local cab still has to be slowed down some, so the synchronizing mode is to delay the local.

Figure 10:
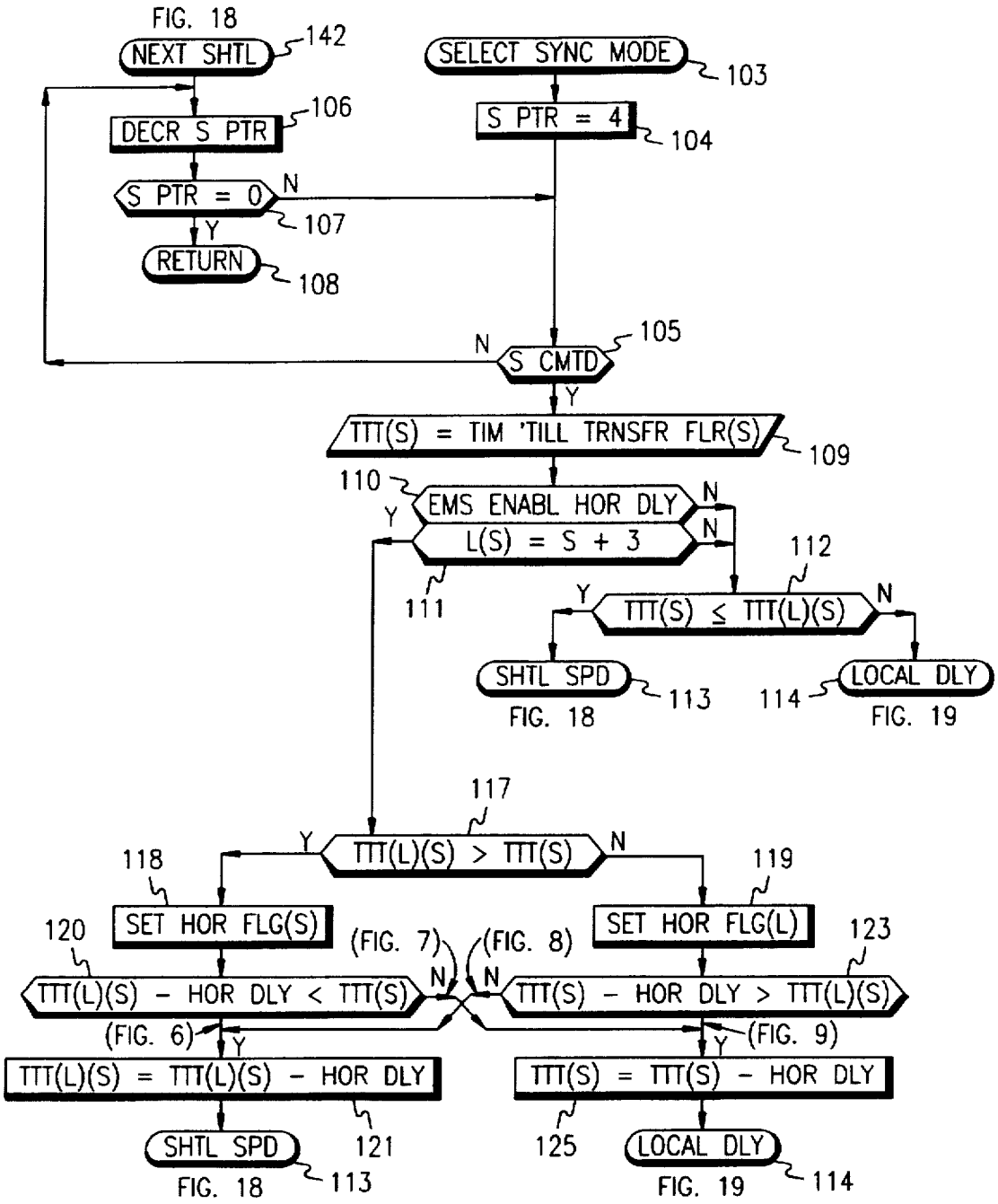

Referring now to FIG. 10, a subroutine to Select the Synchronizing Mode is entered through an entry point 103 and a first step 104 sets an S pointer to point to the highest numbered shuttle in the group, which is four in this example. Then a test 105 determines if shuttle S is committed to a local car. If such is not the case, then synchronizing for shuttle S is not required, so a negative result of test 105 reaches a step 106 to decrement the S pointer to point to the next shuttle in turn. A test 107 determines if all the shuttles have been tested or not, if so, other programming is reverted to through a return point 108. But if not, the next shuttle in turn is tested in test 105 to see if it is a committed shuttle. Assuming it is, an affirmative result of test 105 reaches a subroutine 109 to calculate the estimated time 'till transfer floor (TTT) for shuttle S in the same fashion as described with respect to the local elevator hereinbefore. In the case of the shuttle, there are no stops, and the speed will either be Vmax, acceleration, deceleration, or an average velocity calculated in accordance with the invention to achieve synchronization with a local car. The time may take into account the time to transfer from one hoistway to another at the transfer floor 30, and the additional deceleration and acceleration required to do so. After generating an estimated TTT for shuttle S, a test 110 determines if the circumstances of FIGS. 5–9 are to be ignored, or are to be incorporated in the calculations. If desired, all of the circumstances in FIGS. 5–9 may be ignored totally, or both cabs could be caused to have the same path length even when they are opposing each other. The manner of implementing the present invention is up to the choice of those using it. If the control indicates that circumstances of FIGS. 5–9 are to be taken into account, an affirmative result of test 110 reaches a test 111 to determine if the particular shuttle in question is opposite the local that has been assigned to it. With reference to FIG. 5, it can be seen that in the configuration of FIG. 2 the shuttle numbers on the tracks Y4, Y5, Y6 and Y7 are three numbers lower than the local numbers assigned to those same tracks. Thus, the test 111 determines if the local assigned to the shuttle has a number equal to the shuttle under consideration plus three, indicating they are opposite each other. If not, or if local delay is to be ignored, a negative result of either test 110 or test 111 reaches a test 112 to see if the shuttle TTT is less than the local TTT. If it is, then the shuttle will be slowed down to cause it to arrive at the transfer floor more nearly at the same time as the local, by means of a shuttle speed routine in FIG. 18 which is reached through a transfer point 113. But if the shuttle time is not less than the time for the local to reach the transfer floor, then a negative result of test 112 will designate that the local car shall be delayed in a routine of FIG. 19, reached through a transfer point 114. If the features of FIGS. 5–9 are not to be accommodated, an affirmative result of test 105 can reach through the subroutine 109 directly to the test 112, and the rest of FIG. 10 can be ignored. If the features of FIGS. 5–9 are to be taken into account, an affirmative result of test 111 reaches a test 117 to determine if the time for the local is greater than the time required for the shuttle to reach the transfer floor. If it is, then this is the situation of FIGS. 6 and 7 and a horizontal flag for the shuttle is set in a step 118. But if the time for the local is not greater than that for the shuttle, the situation of FIGS. 8 and 9 obtains and the horizontal flag for the local is set in a step 119. Following the step 118, a test 120 determines if TTT for the local exceeds TTT for the shuttle by more than a horizontal delay, which is the extra time needed for the shuttle cab to get out of the way. If it does, this is the circumstance of FIG. 6 so an affirmative result reaches a step 121 to subtract the horizontal delay from the time remaining for the shuttle to reach the transfer floor. In this fashion, the shuttle can be delayed by an amount which will cause it to get there earlier than it otherwise would, by the amount of the horizontal delay. Similarly, if a test 123 determines that TTT for the shuttle does not exceed TTT for the local by more than the horizontal delay (FIG. 8), then the step 121 reduces TTT for the local by the horizontal delay. The negative result of test 120 is the situation in FIG. 7 and the affirmative result of test 123 is the situation in FIG. 9, will reach a step 125 in which the horizontal delay is subtracted from TTT for the shuttle so that the local will be able to get there a bit sooner to take the longer trip on the transfer floor, as described with respect to FIG. 5. Following the step 124, the shuttle speed routine of FIG. 18 will be reached through the transfer point 113, and following the step 125, the local delay subroutine of FIG. 19 will be reached through the transfer point 114.

It can be shown that if a body going at a first speed decelerates at a given rate it will take the same length of time to decelerate to zero or any other low speed as it will if the body is going twice as fast and decelerates at that given rate. However, the distance covered in that same length of time will be a non-linear function of the speed. As an example, decelerating from a velocity of ten meters per second with a deceleration rate of one meter per second per second will take about two seconds, and will require on the order of 55 meters. Decelerating from five meters per second at the same rate will only take one second and will require about 15 meters. If one were to decelerate a car whose Vmax is 10 meters per second from a Vavg (used for synchronizing purposes) of five meters per second at the same deceleration rate of one meter per second per second, then one would have approximately 40 meters to travel at a creep speed (a door opening velocity) which, if it were one-half meter per second, would take 1⅓ minutes; at one-tenth meter per second it would take nearly seven minutes. The invention takes advantage of the fact that if the rate of deceleration is ratioed to the speed, not only will the deceleration occur in the same length of time, but the distance required will be similarly ratioed to speed in a first order linear fashion. This is illustrated in three scenarios in FIGS. 11–13.

Figure 11:
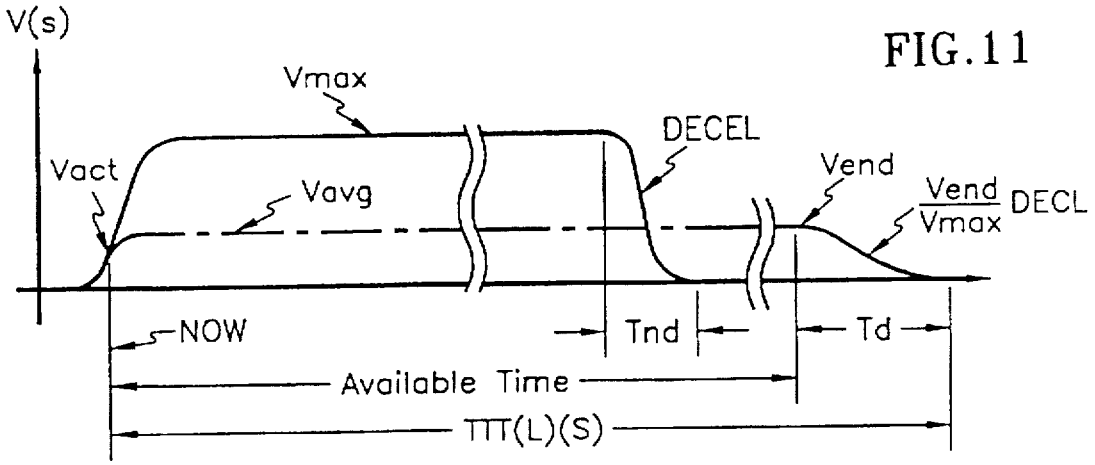
FIGS. 11–13 illustrate different velocity profiles as a function of time.

In FIG. 11, an assignment of a local elevator is made very early in the shuttle trip at the point identified as NOW, and there is some diversity in the TTT of the local from the normal TTT of the shuttle so that a low average velocity, Vavg, perhaps 40% of Vmax, is required to slow the shuttle down for a synchronous arrival at the transfer floor. By utilizing a deceleration rate which is on the order of 40% of the normal deceleration rate, the time for actual deceleration, Td, is the same as the time for normal deceleration from Vmax, Tnd. The same is true in the scenario of FIG. 12 wherein the disparity is so great that the only way synchronism can be achieved is to immediately decelerate the shuttle to a very low average velocity, and in FIG. 13 where synchronous arrival can be achieved by a very slow deceleration of the shuttle from its present actual velocity. In each case, the time for deceleration, Td, is the same as the normal, known time for deceleration, Tnd. In considering time and distance for deceleration, it is assumed that the shuttle car frame is operating under a typical closed loop velocity profile motion control, so that the identical results are achieved regardless of the loading of the car, excluding minute lags or leads due to loading variations. These minute differences are ignored in this consideration.

Figure 12:
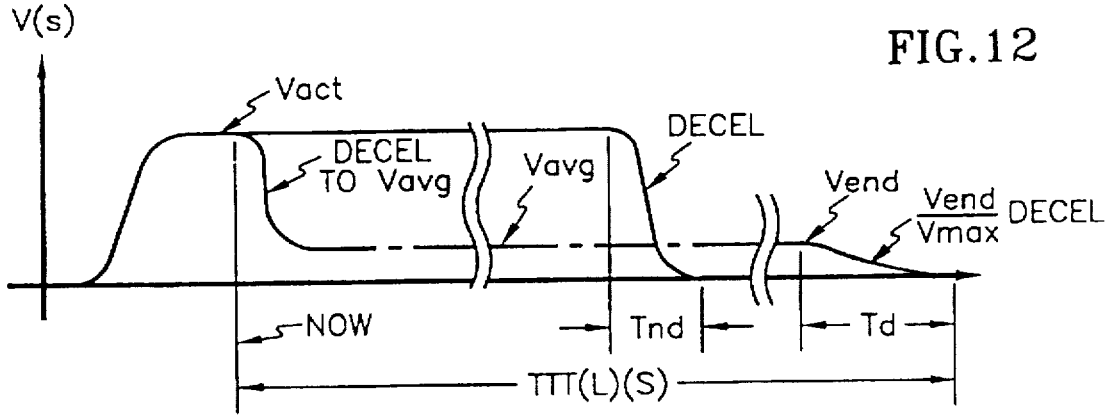
Figure 13:
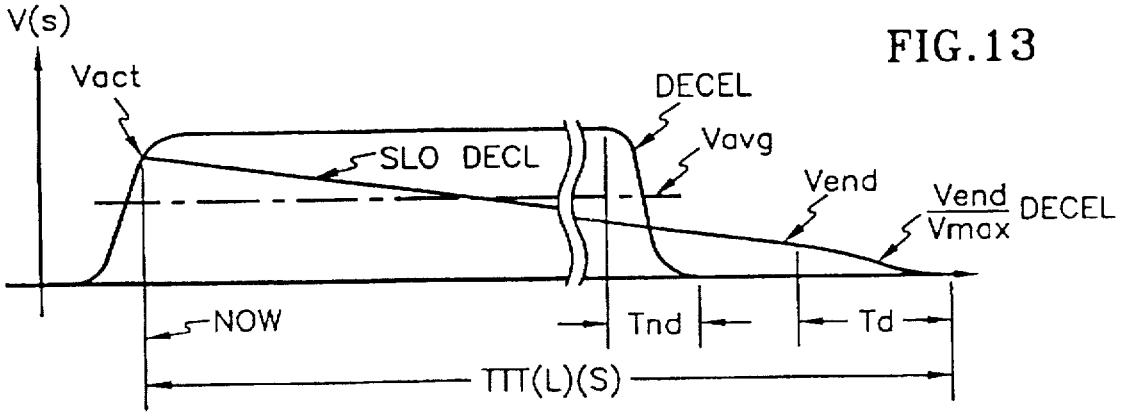

In this invention, the available time, identified as such in FIG. 11, within which to adjust the arrival time of the shuttle to that estimated for the local elevator, is taken to be the total time remaining for the local elevator minus the deceleration time for the shuttle. This is permissible since all that is required is that the shuttle arrive at the proper time. A slow rate of deceleration from a very low speed as in FIGS. 12 and 13 is equally as acceptable as a larger rate of deceleration from a higher speed, as in FIG. 11. Thus, the invention is compatible with the motion factors which control when the deceleration rate is ratioed to the ending speed, Vend, the speed of the car at the point where deceleration begins.

Figure 14:
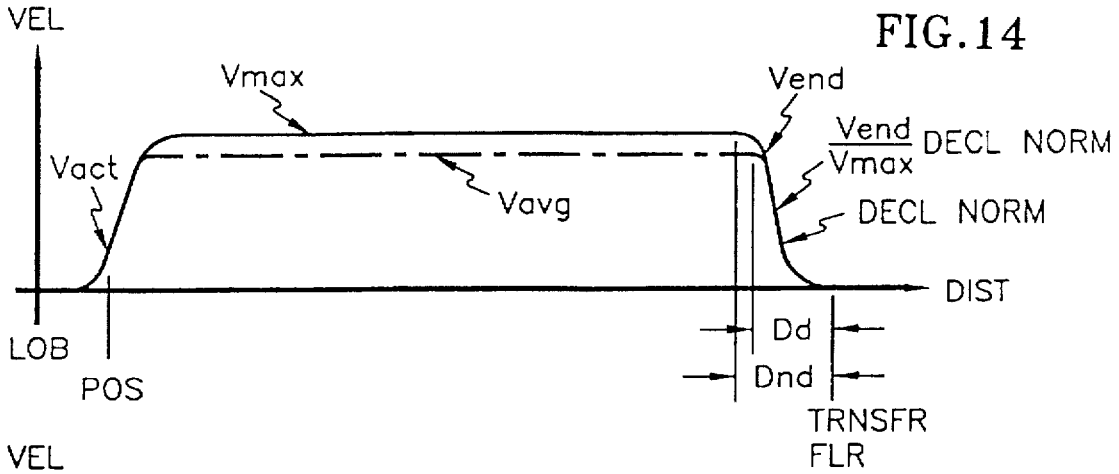
FIGS. 14–17 illustrate different velocity profiles as a function of distance.

The various factual scenarios are depicted in FIGS. 14–17 in each of which velocity is plotted as a function of distance, rather than time. In FIG. 14, the most typical situation is illustrated. Therein, at the time the calculations are made (identified by the current position, POS) and while traveling at some current actual speed, Vact, it is determined that the time estimated for the local car to arrive at the shuttle floor can best be consumed by having the shuttle travel at an average speed, Vavg, which is very near its maximum speed, Vmax. Even though deceleration will begin at the same time as it would from Vmax, it begins at a different distance from the transfer floor as seen in FIG. 14. Then the actual velocity as a function of distance will track very closely to a portion of the deceleration curve related to Vmax. Bear in mind that this is a plot of velocity as a function of distance, not as a function of time. Referring to FIG. 11 in contrast, the slope of the deceleration curve as a function of time is much more gradual for an ending velocity that is much lower than the maximum velocity. This does not appear in a velocity vs. distance plot as in FIGS. 14–17.

Figure 15:
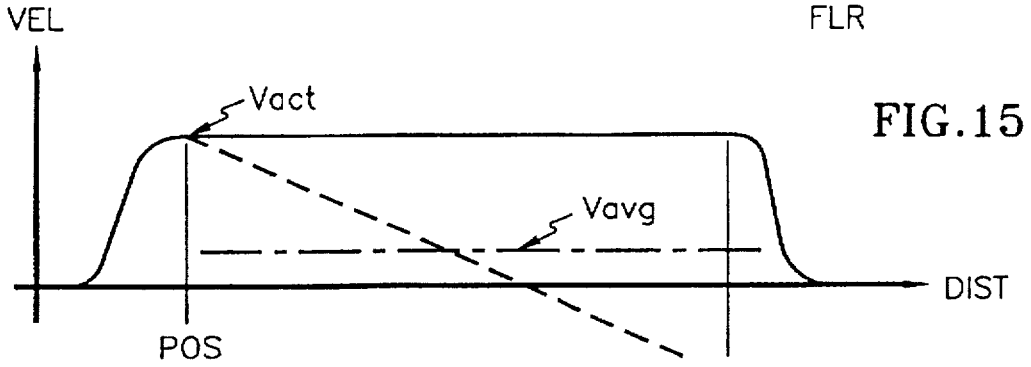
Figure 16:
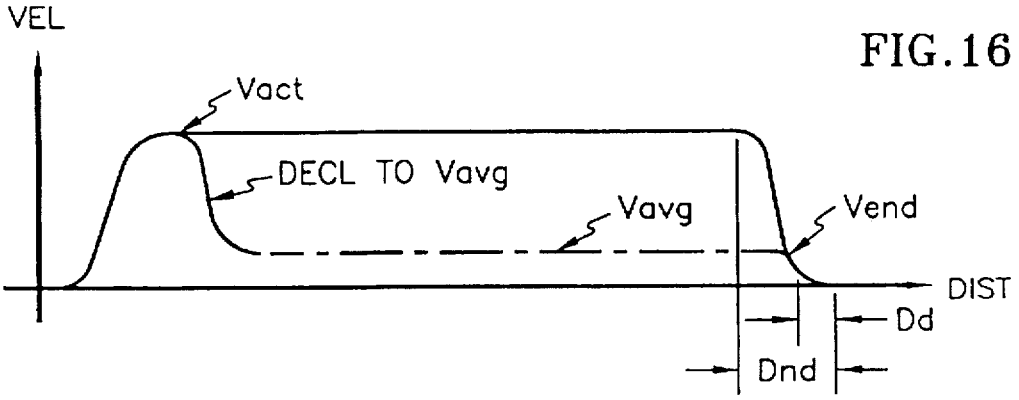

Another scenario is illustrated in FIG. 15. Therein, the actual assignment and calculation occurs after the shuttle has reached Vmax and the average velocity required for synchronous landing is sufficiently low that a slow deceleration to and through that average would not work. Therefore, one of the features of the invention is to decelerate quickly to a very low average velocity as seen in FIG. 16, in those cases where the TTT of the shuttle and the local are widely divergent.

Figure 17:
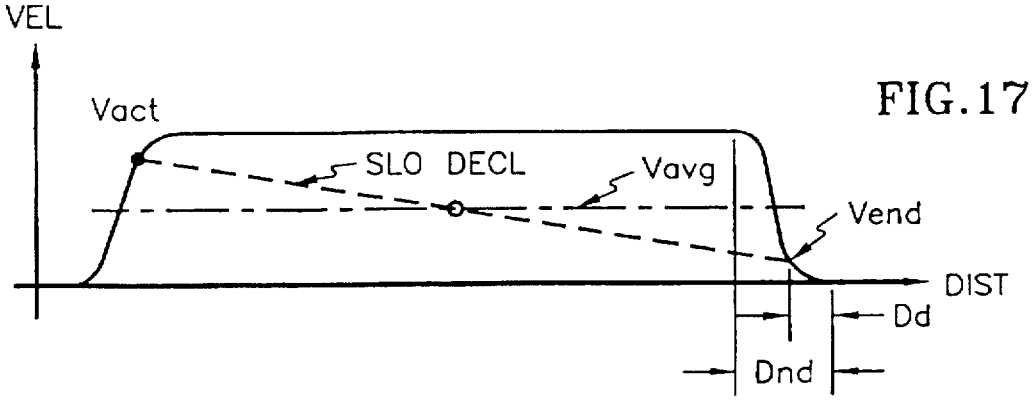

In FIG. 17, another scenario is illustrated. There, the average velocity is somewhere mid range of Vmax (as in FIG. 11) but the shuttle is already going at a speed, Vact, which is higher than that average velocity. Nonetheless, a slow deceleration through the average velocity to an ending velocity which is low, but not too low, will provide a smooth way to reach the result of synchronism.

According to one aspect of the invention, operation as shown in FIGS. 14–17 is utilized to reach synchronization with the local elevator at a transfer floor. As such, the rules are simply that the normal time for deceleration is assumed to remain the same because the distance required to decelerate and the rate of deceleration are both ratioed to the ending velocity, at which deceleration begins. In other words, deceleration will begin at the same time, but at a lower speed it will begin at a distance which is closer to the transfer floor and the rate of deceleration will be lower than is the case for a normal shuttle run at Vmax and normal deceleration rate.

The average velocity, Vavg(S), required to travel the distance from the current position of the shuttle, POS(S), to the point where deceleration begins, Dd(s), in the length of time it will take the local elevator to reach a transfer floor, TTT(L)(S), minus the amount of time required for deceleration, Tnd, is:

$$Vavg(S) = \frac{POS(S) - Dd(S)}{TTT(L)(S) - Tnd} \tag{1}$$

$$Dd(S) = \frac{Vend(S)}{Vmax} \tag{2}$$

$$Vend(S) = 2Vavg(S) - Vact(S) \tag{3}$$

Substituting Eqn. (3) into Eqn. (2), and then Eqn. (2) into Eqn. (1), and simplifying:

$$Vavg(S) = \frac{POS(S)Vmax - Vact(S)Dnd}{TTT(L)(S)Vmax - Tnd\,Vmax} + 2Dnd \tag{4}$$

The factor Vmax is the design rated speed in the motion controller, and is a fixed amount: it can therefore be deemed to be a constant. The same is true of the distance required for a normal deceleration, Dnd: it can be deemed to be a constant. The time required for a normal deceleration, Tnd, is also a constant function of the design of the motion controller. Therefore, in equation 4, the following may be substituted:

Vmax=Kv

Dnd=Kd

Tnd Vmax+2Dnd =Kk so:

$$Vavg(S) = \frac{POS(S)Kv - Vact(S)Kd}{TTT(L)(S)Kv - Kk} \quad (5)$$

Figure 18:
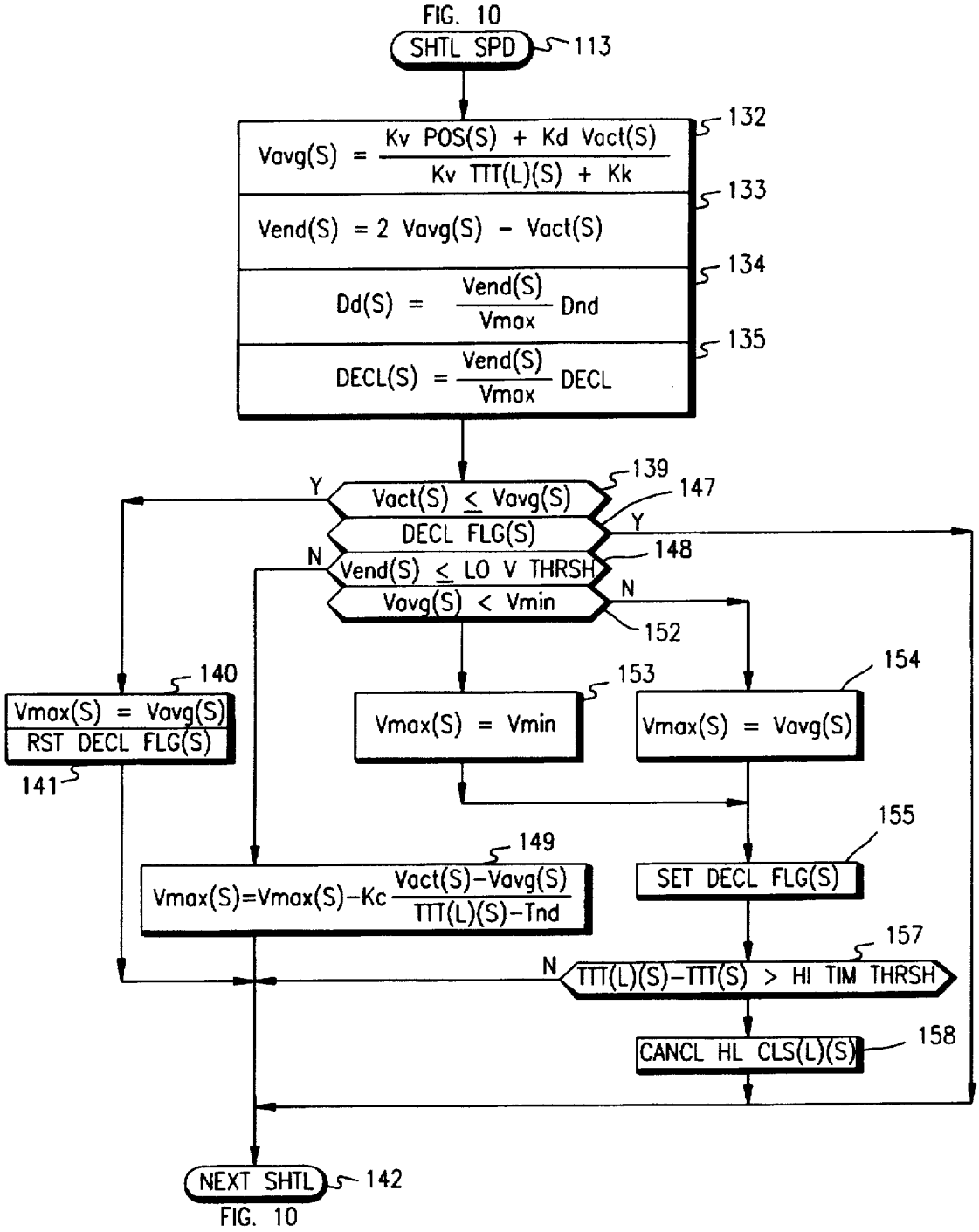

Referring now to FIG. 18, the Shuttle Speed subroutine, reached through a transfer point 113 from the Select Synchronizing Mode subroutine of FIG. 10, begins with a step 132 which determines the average speed required for shuttle S to reach the transfer floor at the same time as the local car, (L)(S), assigned to the shuttle, in accordance with the equations (1) through (5). Then a step 132 determines the ending velocity for shuttle S, Vend(S), at the point where deceleration to a creep, door speed is required, in accordance with equation (3). From this, ratioing to Vmax of the distance for normal deceleration and the normal deceleration rate, DECL, can be performed in a pair of steps 134, 135 in accordance with the teachings of FIGS. 14–17. The values determined in the steps 134 and 135 are provided to the motion controller of shuttle (S) to tell it when deceleration is to begin (Dd(S)) and the rate of deceleration (DECL(S)) to be used. Then a test 139 determines if the current actual speed of shuttle S is equal to or less than the calculated desired average speed for shuttle S. If it is, the simple situation of FIG. 14 obtains, and an affirmative result of test 139 reaches a step 140 to set Vmax in the motion controller for shuttle S equal to the calculated desired average velocity for shuttle S, and a step 141 to reset a deceleration flag for shuttle S, which is described hereinafter. And then the next shuttle in turn can be accommodated by return to the Select Synch Mode subroutine of FIG. 10 through a transfer point 142.

In FIG. 10, the step 106 will decrement the S pointer and the test 107 will determine if all of the shuttles have been handled yet, or not. If so, an affirmative result of test 107 causes other programming to be reverted to through the return point 108. But if not, a negative result of test 107 causes the test 105 to determine if shuttle S is committed, or not. If shuttle S is already committed, then the program will continue as described hereinbefore but if shuttle S has not been assigned to a local car, then there is no need to compute a velocity profile for it, so a negative result of test 105 will again revert to the step 106 to decrement the S pointer, as described hereinbefore. If the shuttle is committed, the appropriate steps and tests 111–125 will be accommodated, and the program may revert again through the transfer point 113 to FIG. 18.

In FIG. 18, assuming that the actual speed of the shuttle is not less than the calculated desired average speed for the shuttle, the test 139 will be negative. This reaches a test 147 to determine if the deceleration flag for shuttle S has been set yet or not. This flag keeps track of the fact that the situation of FIG. 16 has occurred, and causes all of the remaining program of FIG. 18 to be bypassed during the period of time that shuttle S is being decelerated to the calculated desired average velocity. An affirmative result of test 147 therefore reverts to FIG. 10 through the next shuttle transfer point 142.

If the deceleration flag is not set (which will always be the case, initially), a negative result of test 147 will reach a test 148 to determine if the calculated ending speed for shuttle S is less than some low velocity threshold. This could be some amount such as 10% of Vmax or the like which could indicate a condition as illustrated in FIG. 15. In fact, the amount could be 0% of Vmax except for the fact that the ability to slow down even further might be desired to accommodate for changes in the behavior of the local elevator assigned to this shuttle. However, the value of the low velocity threshold of test 148 can be selected to suit any utilization of the invention, and is irrelevant. If the calculated ending velocity is not below the threshold, a negative result of test 148 will reach a step 149 to decrement the target velocity of the motion profile for shuttle S, Vmax(S) in the manner to reflect the slow deceleration illustrated in FIG. 17. The average deceleration for the slow deceleration of FIG. 17 is the difference in velocity over the time that this occurs:

$$Avg\ DECL(S) = \frac{Vact(S) - Vend(S)}{TTT(L)(S) - Tnd} \quad (6)$$

combining with Eqn. (3) and simplifying:

$$Avg\ DECL(S) = \frac{2\{Vact(S) - Vavg(S)\}}{TTT(L)(S) - Tnd} \quad (7)$$

To cause this deceleration to occur, Vmax for shuttle S is adjusted in a manner related by a constant, Kc, having to do with the cycle time of the computer to the average deceleration desired as set forth in Eqn. 7. This is performed in FIG. 18 at step 149 in each pass through the subroutine of FIG. 18. And then a next shuttle may be handled in FIG. 10 through the transfer point 142, as described hereinbefore.

Assume now that the ending velocity is less than the low velocity threshold so test 148 is affirmative. This will reach a test 152 to determine if the calculated desired average speed for the shuttle is less than some minimal amount, Vmin. This minimal amount might be zero except for the fact that the shuttle should move to the transfer floor regardless of when the local elevator will arrive at the transfer floor. Therefore, Vmin might be any value below which the shuttle is not allowed to travel. If the calculated average speed for the shuttle is less than Vmin, an affirmative result of test 152 will reach a step 153 to set the maximum velocity in the velocity profile for shuttle S, Vmax(S), to Vmin. On the other hand, if the average velocity which has been calculated is not less than the minimum velocity, a negative result of test 152 will reach a step 154 to set the maximum velocity in the velocity profile for shuttle S equal to the calculated desired average velocity. Then a step 155 will set the decel flag to allow the shuttle to decelerate to the desired average velocity, as shown in FIG. 16. A test 157 determines if the currently expected time for the local elevator assigned to this shuttle to reach the transfer floor, TTT L(S), exceeds the currently estimated time for this shuttle to reach the transfer floor, TTT(S), by more than some high time threshold. If it does, then a step 158 may set a flag which will cause the hall calls in the local elevator assigned to shuttle S to be cancelled, as described with respect to FIG. 22, hereinafter. It should be noted, if hall calls are cancelled, then the TTT for the local car assigned to shuttle S may change dramatically, so that in a subsequent pass through FIG. 18 different results may be reached. However, when any shuttle passes through step 158, it will have set the decel flag in step 155 so that no further processing in the steps and tests 148–158 will occur for this shuttle until such time as that shuttle descends to a speed equal to the calculated desired average speed. Once that has happened, a new calculated average speed may be higher than the actual speed so the car may increase speed from the low average speed of FIG. 16 in order to synchronize with the local car which will now get to the transfer floor much quicker, having no hall calls.

After step 158, FIG. 10 is reverted to through the transfer point 142. When all of the shuttles have had their synchronizing mode selected and speed calculations accommodated, test 107 will be affirmative causing other routines to be reached through the return point 108. In a subsequent pass through the routine of FIG. 18, when the shuttle has decelerated to the low average speed as in FIG. 16, test 139 will now be affirmative reaching the steps 140 and 141 establishing Vavg as the target speed in the motion controller for shuttle S, and resetting the decel flag. It should be noted that as long as the shuttle must be slowed down to synchronize with the local car, a new desired V average will be calculated in step 132 of FIG. 18 in each pass through the routines of FIGS. 10 and 18. The invention thus accommodates changes in the situation, as the two committed cars approach the transfer floor.

According to the invention, the possibility that the assigned local car will reach the transfer floor before the shuttle unless the local car is delayed is accommodated, as well. In FIG. 19, a Local Delay routine is reached, when appropriate, from FIG. 10 through the transfer point 114. Therein, a first step 159 sets a number, D, representing the number of assigned stops for the local car assigned to this shuttle, including car calls and assigned hall calls, which are ahead of and still to be answered by the local car. A step 162 generates the difference, DIF, between the TTT of the shuttle and the TTT of the local car. Then a door delay is generated in a step 163 as the difference in arrival time divided by the number of stops. This is a delay which is added to the normal door time so as to cause the local car to spread additional waiting time among its various stops, thereby to achieve synchronization with the shuttle in accordance with the invention. A step 164 sets a door delay flag to keep track of the fact that there is a door delay, for use as described with respect to FIG. 20, hereinafter. A test 165 determines if the door delay for the local car is greater than a delay threshold in a test 165, and if it is, the step 161 will decrement the speed of the local car. A test 160 determines if D is zero; if there are no further stops, the routine advances to a step 161 which decrements the speed of the car, such as by setting the local car into a slow mode in which the speed of the local car is reduced. In a subsequent pass through the routine of FIG. 19 for the same local car, the calculation of the TTT for that car will have again been made in the subroutine 44, FIG. 3, utilizing the new, slow mode speed. Therefore, the TTT of the local car assigned to the shuttle S will be greater in the subsequent pass through FIG. 19, so the door delay will be less. In this fashion, excessive door times can be reduced by lowering the speed of the local car. Of course, if test 165 is negative, the mode is not altered in step 161. In any event, after the test and step 165, 161, consideration of the next shuttle in turn is reached in FIG. 10 through the transfer point 142. If desired, the step 161 could decrement the speed of the local car by some amount each time that test 165 is affirmative, slowing the local car down to a crawl, if necessary; thus, decrementing speed includes doing it one or more times. All of this is up to the designer of an elevator system employing the present invention.

Thus far, a local car that is ready to be matched with a shuttle is selected in FIG. 3, a shuttle is selected to be dispatched and matched with the local car in FIG. 4. In FIG. 10, the determination is made as to whether synchronization is to be achieved by manipulating shuttle speed, or by delaying the local car, for each shuttle and its committed car, in each cycle through the routine, the subroutines of FIGS. 18 and 19 providing the appropriate delay as part of the routine including FIG. 10.

Figure 20:
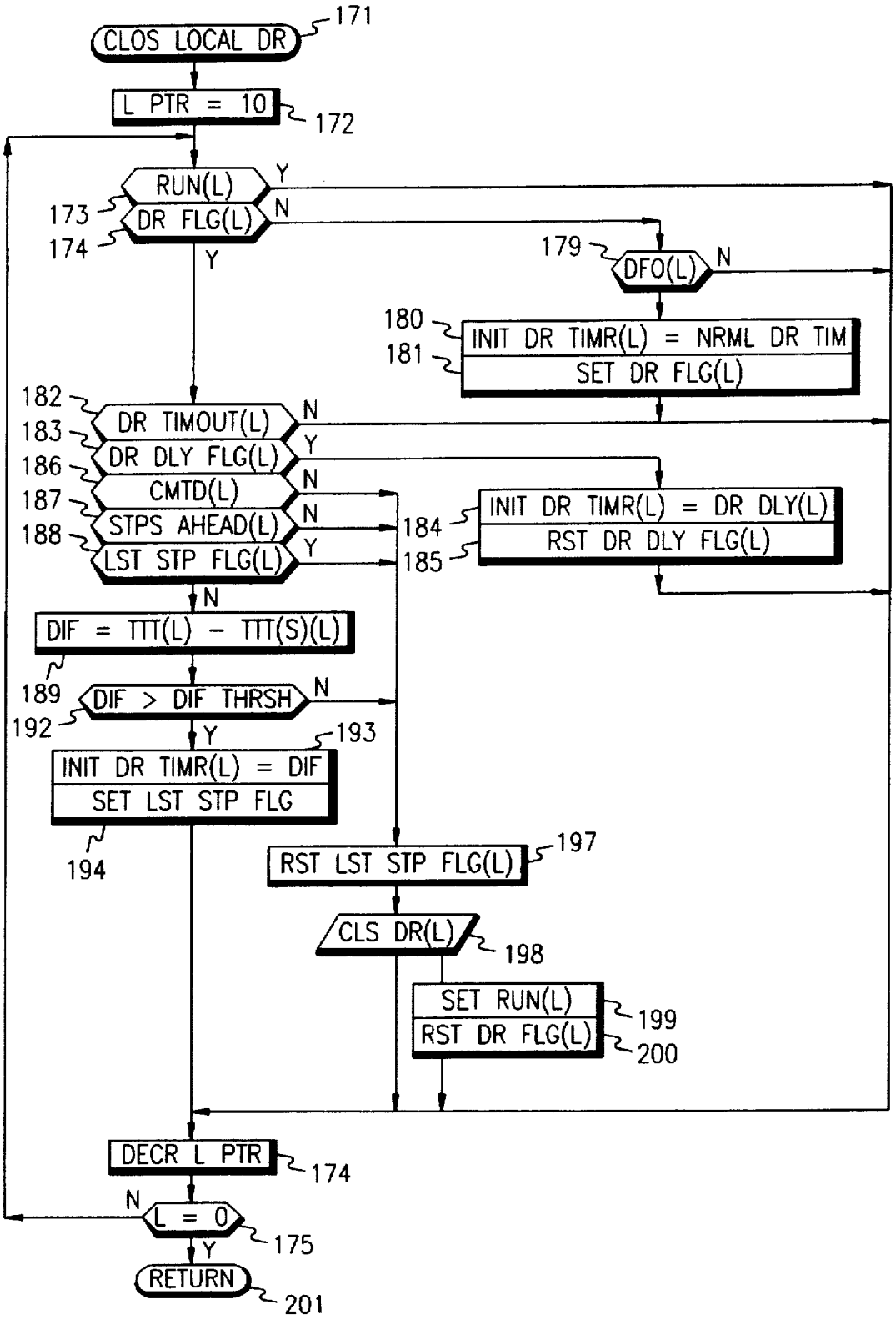
FIG. 20 is a logic flow diagram of a local door closing routine, which can hold the local car door open at the last stop before a transfer floor, to achieve synchronization.

A totally separate additional means of slowing a local car to synchronize it with the shuttle, if necessary, is illustrated in FIG. 20. Therein, a Close Local Door routine is reached through an entry point 171 and a first step 172 sets a local car pointer, L PTR, equal to the highest number of local cars in the group, which in this example is ten. A test 173 determines if local car L is running. If it is, the remainder of the routine is bypassed with respect to that car, reaching a step 174 which decrements the L pointer to point to the next local car in turn (9 in this example) and a test 175 determines if all of the cars have been considered, or not. If not, the routine reverts to the test 173.

Assuming that car L is not running, a test 174 determines if a locally used door flag for car L has been set, or not. In the first pass through FIG. 20 with respect to car L after car L ceases to run, the door flag will not have been set. In such case, a negative result of test 174 will reach a test 179 to determine if the door of car L is fully open. If not, the remaining routine of FIG. 20 is bypassed this time with respect to car L. Eventually, in a subsequent pass through this routine with respect to car L, its door will be fully open so an affirmative result of test 179 will reach a step 180 to initiate the door timer for car L to thereby determine at what point the door should begin to close at the end of the stop, and a test 181 will set the door flag for car L, which is tested in test :L74. And the remainder of the routine of FIG. 20 is bypassed for car L in this pass.

In a subsequent pass through FIG. 20 with respect to car L, test 173 is negative but now test 174 will be affirmative reaching a test 182 to determine if the door timer for car L, set in step 180, has timed out, or not. Initially it will not have, so the remainder of the routine for car L is bypassed at this time. Eventually, in a subsequent pass, the door timer for car L will have timed out, so test 182 will be affirmative reaching a test 183 to determine if the door delay flag of FIG. 19 has been set, indicating that the local car is to be delayed by holding its doors open an extra amount at each stop, as described hereinbefore. Assume that such is the case, an affirmative result of test 183 will reach a step 184 to initiate the door timer again, but this time to initiate it to the door delay for car L that is established in step 163 in FIG. 19. Then the door delay flag is reset in a step 185. In a subsequent pass through the routine of FIG. 20 for the same car, L, test 173 will be negative, test 174 will be affirmative, test 182 will be negative because the door timer has been reinitiated to accommodate the delay. Therefore, the rest of FIG. 20 is bypassed with respect to car L. Eventually, the door timer will time out once again so that test 182 will be affirmative reaching test 183. This time, test 183 is negative since the door delay flag has previously been reset in step 185. A negative result of test 183 reaches a test 186 to see if the local car is a committed car yet, or not. The description thus far has assumed that it was a committed car because a delay had been requested. For a committed car, test 186 is affirmative reaching a test 187 to determine if there are stops ahead of car L. If not, that means that car L is currently at its last stop before reaching the transfer floor. In accordance with the invention, if for some reason the local car could reach the transfer floor too soon so that its passengers could be waiting at the transfer floor in a closed, stopped car, the doors are held open in the amount that is necessary at the last stop, before closing them to travel to the transfer floor. In doing this, a negative result of test 187 reaches a test 188 to determine if a last stop flag has been set for car L; this flag is used to keep track of the fact that a last stop door delay is occurring, as described hereinafter. And then, in a step 189, the difference, DIF, is taken between the TTT for the local car and the TTT for the shuttle which is assigned to the local car. In test 192, if this difference exceeds a threshold, DIF THRSH, which may be on the order of one or two seconds, or nothing, then an affirmative result of test 192 will reach a step 193 to initiate the door timer one more time, but this time, it initiates to the value of the difference taken in step 189. If the shuttle will reach the transfer floor first, the result of test 189 is negative, so no additional delay occurs. Then a step 194 sets the last stop flag for car L so that in a subsequent pass through FIG. 20, after the door timer times out again, test 188 will be affirmative reaching a step 197 to reset the last stop flag for car L. Then a closed door subroutine 198 is initiated for the cab on the selected car, L, which as it waits for door motion, will reach the step 174 and test 175 several times to deal with the next local car in turn. In subsequent passes through the routine of FIG. 20, for a car which has reached the closed door subroutine 198, will be test 173 is negative, test 174 is affirmative, test 182 is affirmative, test 183 is negative, test 186 may be negative if the car is doing ordinary interfloor stops and is not yet committed, or test 187 may be negative in which case test 188 will be affirmative thereby once again reaching step 197 (redundantly but harmlessly) and returning to the closed door subroutine 198. Eventually, when the door of the cab for car L is closed, the subroutine 198 will include a step 199 to set the run condition for car L, so that the car can now advance to the transfer floor, and a step 200 will reset the door flag for car L which is set in step 181 in the beginning of the door process.

Consider a car which is simply delivering and picking up passengers, and is not committed to a shuttle. When test 173 is negative indicating that the car has stopped at a landing, initially test 174 will be negative, reaching the test 179. Initially, the remainder of the program is bypassed by a negative result of test 179; but once the car's doors are fully open, in a subsequent pass through the routine of FIG. 20 for car L, test 179 will be affirmative reaching the step 180 to initiate its door timer to the normal door time and a step 181 which will set the door flag for that car. In a subsequent pass through FIG. 20 for the non-committed car, eventually the door timer will time out so that test 182 will be affirmative. Since this car is not involved with synchronizing to a shuttle, test 183 will be negative and test 186 will be negative, directly reaching the step 197 which redundantly resets the last stop flag for this car (which had not been set). Then the doors are closed and run is set, and the door flag is reset, as described hereinbefore. When all of the cars have been treated, test 175 in FIG. 20 will be affirmative, causing other programming to be reached through a return point 201.

The routine of FIG. 20 is reached many times a second and runs through all ten cars each time that it is run. In each case, the L pointer is decremented in step 174 and the test 175 determines when each of the local cars has been treated during this pass through FIG. 20. For many of the cars when they are running, all that occurs is that step 173 is affirmative bypassing the remainder of the routine. During normal stops before commitment or synchronizing, only the normal door time out and closing door functions are performed. For a car that is committed, there may be extra delay or there may not. If the shuttle will arrive at the transfer floor before the local car, then none of the local car delays of FIGS. 19 and 20 will be utilized. Thus, the local car can be slowed down so as to be synchronized with the shuttle in all events, by adding door delay to a number of stops, by running in a slower mode, or as a last chance effort, by holding the car at its last stop until an appropriate time to ensure contiguous arrival with the shuttle.

Figure 21:
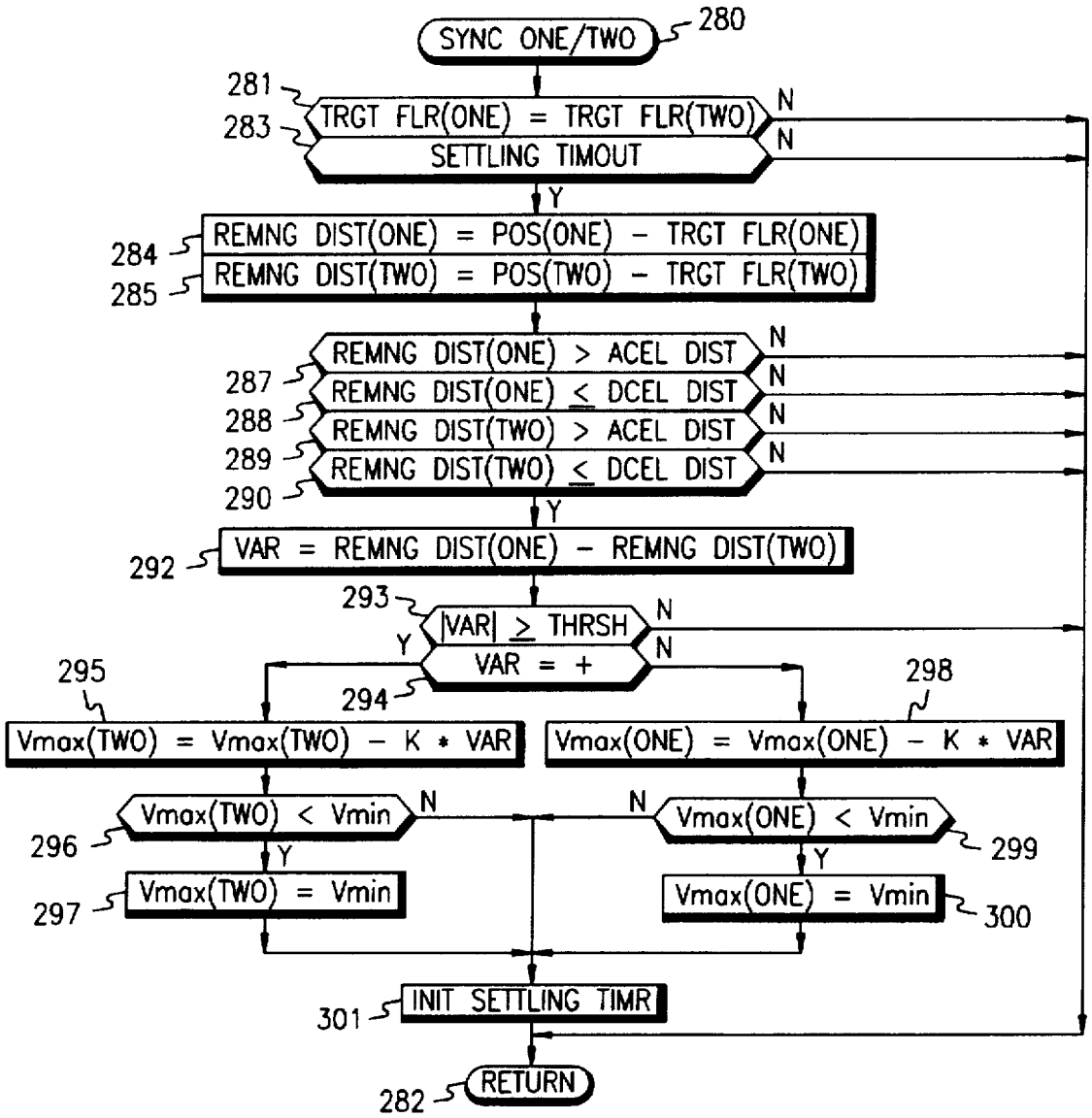
FIG. 21 is a logic flow diagram of a simple synchronizing program, useful for adjusting the time a shuttle elevator will arrive at a transfer floor to exchange a cab with another shuttle elevator.

The description thus far has to do with synchronizing the shuttles S1–S4 to selected ones of the local cars L1–L10 with which the shuttles are paired to exchange cabs. In the foregoing description of synchronizing the shuttles to the local cars, the shuttle was dealt with as a single entity as if it were a single car frame. This may typically be the case. On the other hand, the situation may be that disclosed in FIG. 2, where there is a lower hoistway overlapped with an upper hoistway and the cab is transferred from the car frame of one hoistway to the car frame of the other hoistway. In fact, the likelihood is that the shuttles will utilize double deck cabs and exchange cabs at the transfer floor 30, in a fashion disclosed and claimed in the parent application. Or, there may be more than two hoistways with cabs being exchanged at two transfer floors, in a manner disclosed and claimed in U.S. patent application Ser. No. 08/588,577, filed on Jan. 18, 1996. In any case, the arrival time of a cab at the transfer floor 26 can be predicted, since the shuttles travel in a predictable fashion. In FIG. 2, normally, a car frame in a lower shuttle standing at the lobby 29 will be dispatched immediately upon exchanging cabs with one of the landings. On the other hand, the car frame in the upper hoistway of the shuttle standing at the transfer floor 26 will normally be dispatched immediately upon receiving a cab from a carrier on the transfer floor. Therefore, the delay provided to the car frame in the upper hoistway of one of the shuttles (a specific shuttle, such as S1) will normally also be provided identically to the car frame in the lower hoistway of the same shuttle. This will cause them to arrive at their respective floors (the transfer floor 26 or the lobby 29) at the same time, so that they will ostensibly be redispatched at the same time. However, should car loading and system gains result in one of the car frames not being fully synchronized with the other car frame of the same shuttle, so that they will meet at the transfer floor 30 at exactly the same time, any of the appropriate shuttle speed program features described hereinbefore may be utilized as the upper car frame travels down and the lower car frame travels up, to cause them to be synchronized. Or, a simpler program, one that typically might be used for a simple shuttle system of the type disclosed in FIG. 1, might be utilized. Such a simple system for synchronizing two car frames of a shuttle that are to meet at a transfer floor (such as the transfer floors 21 and 30) is illustrated in FIG. 21. This feature is also described with respect to FIG. 15 of the parent application.

Referring now to FIG. 21, a synchronizing routine as it may be utilized for cars one and two in FIG. 1, may be reached through an entry point 280, and a first test 281 determines if both cars have the same target floor; if not, this means that car one is headed for the lobby and car two is headed for the upper transfer floor, and there is no point in synchronizing them. Therefore, a negative result of test 281 causes other programming to be reverted to through a return point 282. When both cars are headed for the transfer floor 21, an affirmative result of test 281 reaches a test 283 to determine if a settling timer, used to allow speed adjustments to be reached in one of the cars and described hereinafter, has timed out or not. When it has not, the remainder of the routine of FIG. 21 is bypassed and other programming is reached through the return point 182. However, initially the timer will not have been initialized, so an affirmative result of test 283 will reach a step 284 to calculate the remaining distance for car one as the difference between its present position and the position of the target floor for car one. A step 285 similarly determines the remaining distance for car two. Then a test 287 determines if the absolute value of the remaining distance for car one is less than some initial distance which the cars normally utilize to accelerate. If it is, synchronizing is not yet to be attempted, so a negative result will reach the return point 282. But if the test 287 indicates car one has reached the maximum velocity portion of a normal velocity profile, a test 288 determines if it has yet reached that portion of the profile where deceleration may begin. If it has, an affirmative result of test 288 similarly will bypass the remainder of the program. Tests 289 and 290 in the same fashion determine whether car two is within the nominal maximum velocity portion of its velocity profile. If not, the routine is bypassed.

If both cars are in that portion of their velocity profile that normally causes the car to run at a target maximum velocity, the tests 287–290 will reach a step 292 in which the variation in remaining distance between the two cars is calculated. The absolute value of this variation may be checked in a test 293 against some low threshold, to avoid unnecessary hunting in velocity which could cause passenger anxiety. If the variation is sufficient, an affirmative result of test 293 reaches a test 294 to see which of the two cars has the longest distance to go. If the result of step 292 is positive, car one has a greater distance to go and car two should be slowed down so that the two cars will arrive at the transfer floor 21 at nearly the same time. An affirmative result of test 294 therefor reaches a step 295 to adjust the maximum velocity utilized in control of car two by an amount proportional to the variation in the remaining distance. Instead, predetermined adjustments, equal to a given small percent of Vmax, so as not to disturb the passengers, may be made in subsequent passes through FIG. 21, independent of the variation, VAR. Then a test 296 determines if the adjusted maximum velocity for car two is less than some minimum value of velocity which may be established for ride comfort purposes. If the adjusted maximum velocity for car two is less than some minimum value, a step 297 may set it at that minimum value. Similar steps and tests 298–300 will adjust the maximum velocity of car one if car two has a longer distance remaining.

Whenever the speed is adjusted in either one of the cars, by any of the steps 295, 297, 298 or 300, it will take some time for that car to achieve that speed. Additionally, once the speed of the closer car is slowed some, it will also take some time before the distances of the two cars from the transfer floor 21 will be within the threshold of test 293. Therefore, whenever Vmax is adjusted in any of the steps 295–300, the settling timer is initialized in a step 301. And then other programming is reached through the return point 182. In the next subsequent pass through the routine of FIG. 21, the settling timer will not have timed out, so the entire routine is bypassed and other programming reached through the return point 182. The bypassing will continue until the settling timer times out, in which case the entire process is repeated once again. In this way, the two cars are iteratively brought closer into spatial synchronism with each other.

In some situations, the length of the hoistway of an upper portion of a shuttle may differ from the length of the hoistway of a lower portion of the shuttle; or, one of the two shuttles may have a lighter machine or a machine operating at a different speed than the other of the shuttles. In any case, the foregoing embodiments may be utilized simply by accommodating the known difference in scheduled time for a trip, or the known difference in position. This accommodation may be similar to that described hereinbefore with respect to the delay for one cab to get out of the way of the other (FIGS. 5–10), or with respect to the time and distance for deceleration. In any case, since time is the critical factor, in that contiguous arrival is desired so that passengers do not become anxious waiting in closed static cars, time may be the best metric for achieving synchronization. Thus, a time routine of the sort described with respect to FIG. 18 may be preferable to a distance routine of the type described with respect to FIG. 21.

In FIG. 18, step 158 cancels hall calls for the local car if the local car is much delayed from the expected arrival time of the shuttle, to hasten the arrival of the local car. Of course, if every committed car had its hall calls cancelled, downwardly traveling passengers in the lower portions of the local elevator rises would not be able to get any service at all. The invention also accommodates tending to not assign (penalizing) hall calls to a local car if it is a bit tardy in reaching the transfer floor, as a measure to help hasten a tardy car. Both of these functions are accommodated in a modification of an assignor routine, the pertinent portion of which is illustrated in FIG. 22. This is an adaptation from the relevant portion of an assignor routine set forth in FIG. 11 of U.S. Pat. No. 4,363,381, which discloses a classic relative system response (RSR) method of assigning calls. Of course, the modifications about to be described which relate to the present invention may be provided in any assignor routine.

In FIG. 22, an assignor routine is reached through an entry point 307. A plurality of functions are performed to develop a relative system response factor, RSR, as described in the aforementioned patent. At the point where the assignor gives preference to a car which already has been assigned the call (to avoid switching it back and forth) the purposes of the present invention can be accommodated. In that portion of the routine, a test 308 determines if hall calls for car L should be cancelled, as established by the step 158 in FIG. 18. If so, an affirmative result of test 308 reaches a step 309 where the relative system response is set to some maximum value, such as a value of 256 in a system in which normal RSR values may range between 20 and 100. On the other hand, if the previous routine has not commanded that the hall calls be cancelled, a negative result of test 308 will reach a step 310 to generate a difference value, DFR, as the difference between the length of time that this local car will take to reach the transfer floor minus the length of time that the shuttle to which this local car is assigned will take to reach the transfer floor. Then a test 313 determines whether this call was previously assigned to car L. If not, a test 314 determines if car L is committed. If it is committed, a test 315 determines if the difference factor is greater than some threshold, DFR THRSH. If that is true, then the step 309 is reached to set RSR equal to a maximum value. But if the car is not committed, or even if committed, if the difference in estimated running time to the transfer floor is not great, a negative result of either test 314 or 315 will bypass step 309 and cause the remainder of the assignor program to be performed, after which other programming is reached through a return point 319. If the call in question was previously assigned to car L, an affirmative result of test 313 reaches a test 320 to determine if car L is committed (the same as test 314). If so, a test 321 determines if the difference in running time exceeds the threshold, the same as test 315. If the call was previously assigned to this car, this car is committed and the time difference is more than the threshold, an affirmative result of test 321 reaches a step 322 to increase the RSR value as a function of the difference determined in step 310. Thus, a value related to 5, 10 or the like seconds of delay might be added to the RSR for this car. In this way, there can be a tendency to not reassign calls to tardy cars, which may help them arrive more nearly on time at the transfer floor. At the same time, simply raising the RSR value of a car that previously was thought to be a good choice for assignment of the call does not preclude any calls from being answered near the end of the down run.

An obvious modification to the embodiment of FIG. 22 is to have an affirmative result of test 315 cause the RSR value for possible assignment of this call to this car to simply be increased by some amount, perhaps proportional to the difference of step 310, in the same fashion as step 322. However, if the call was not previously assigned to this car and this car is already tardy, then it may be best to prevent the call from being assigned in the first instance as in the step 309. All of this is irrelevant to the present invention and may be tailored to suit any implementation thereof.

Figure 23:
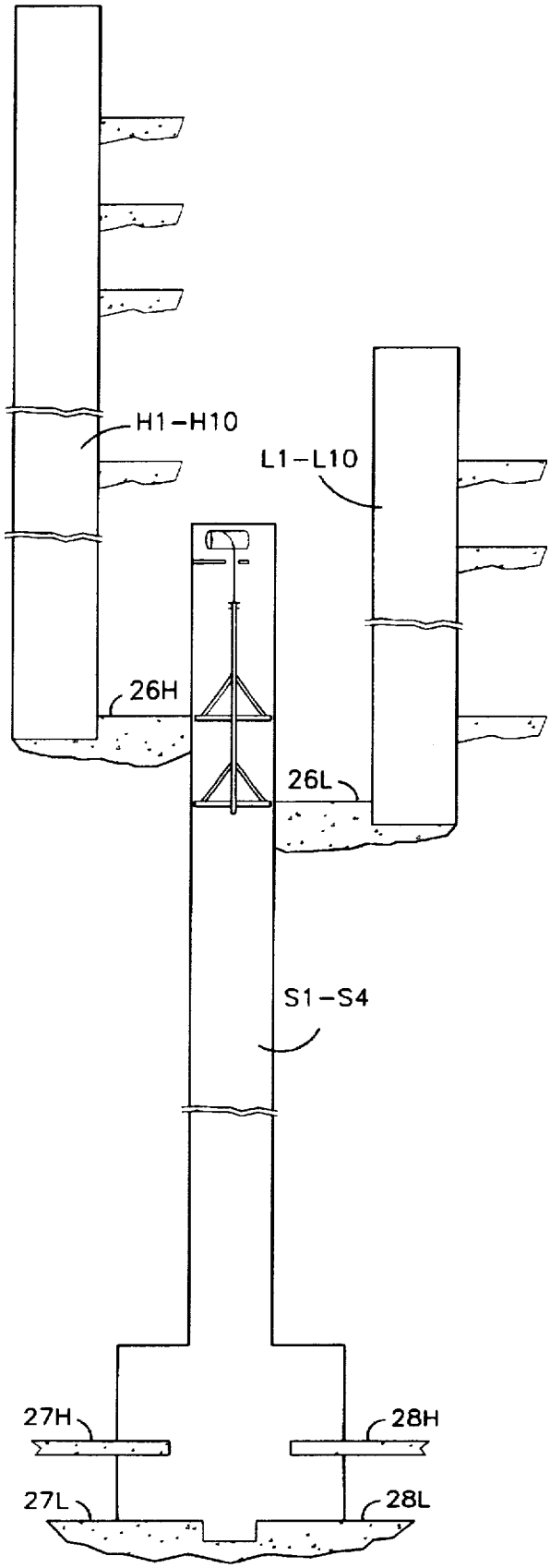
FIG. 23 is a partial, partially sectioned, stylized side elevation view of a third elevator system having a double deck shuttle feeding a low rise elevator group and a high rise elevator group which may employ the present invention.

The description thus far illustrates synchronizing a pair of elevators in accordance with the invention. The invention may be used to synchronize more than two elevators. Referring now to FIG. 23, a plurality of shuttles, S1–S4 each have a double deck car frame 330 which can deliver a low rise cab from low rise lobby landings 27L, 28L to a low rise transfer floor 26L for exchange with a low rise cab provided to the low rise transfer floor 26L by a plurality of low rise elevators L1–L10, and can similarly exchange cabs on a high rise transfer floor 26H from high rise lobby landings 27H, 28H with a plurality of high rise elevators H1–H10. Each of the transfer floors 26H, 26L is assumed in this embodiment to be identical to the transfer floor 26 of FIG. 2. The floor landings may be on either or both sides of the hoistways of the local elevators L1–L10, H1–H10. The advantage of this embodiment is that the shuttle hoistways will carry two cabs at a time, instead of one, thereby much relieving the burden on core at the lower end of the building.

Figure 24:
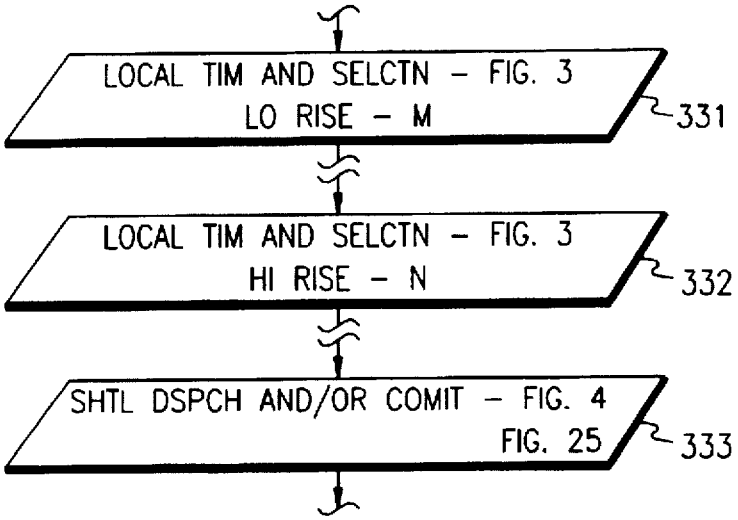
FIG. 24 is a partial, simplified logic flow diagram of the manner in which the second embodiment of the present invention utilizes the routines of FIGS. 3 and 4.
Figure 25:
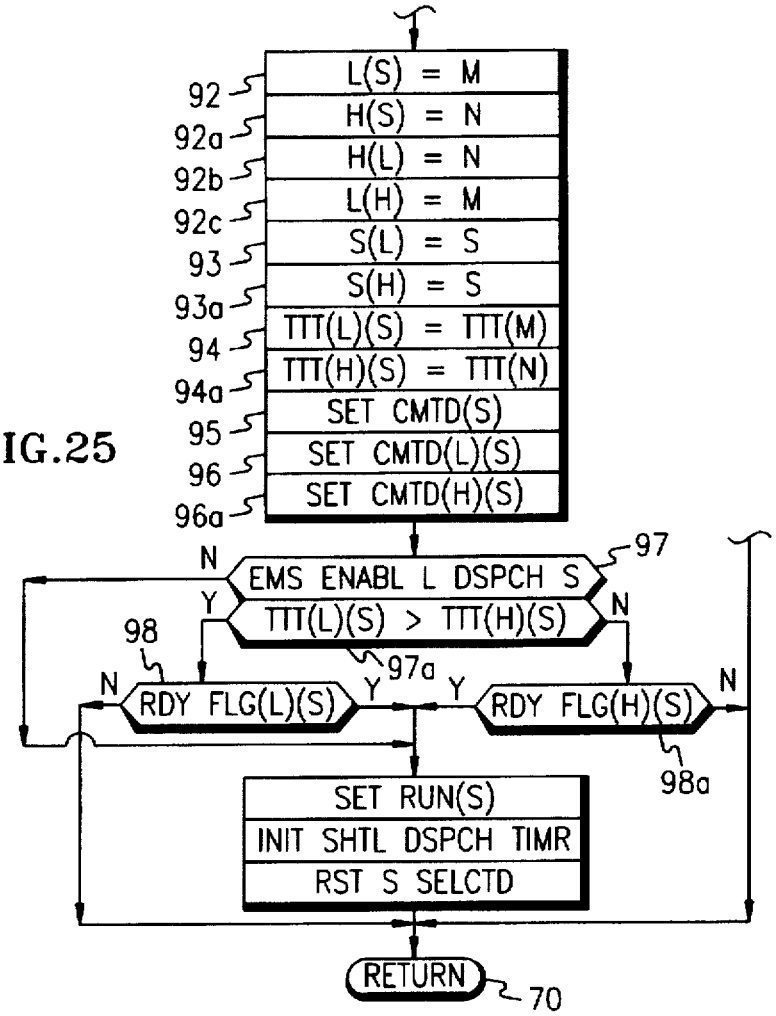
FIG. 25 is a partial logic flow diagram illustrating changes made in the routine of FIG. 4 in order to synchronous three elevators in accordance with this embodiment of the invention.

The synchronizing of three cars can be accomplished utilizing the teachings hereinbefore for two cars, with very minor modifications. Referring to FIG. 24, to accommodate three elevators, what is required is that the local program be provided for the low rise and for the high rise as illustrated by the routines 331 and 332. Thus, within the low rise group L1–L10 of FIG. 23, several times a second the routine of FIG. 3 will be reached with respect to those low rise elevators, and a next low rise elevator to meet with the high rise elevator and a shuttle will be selected and designated as M, as described hereinbefore with respect to FIG. 3. Similarly, the routine 332 indicates that the same program, but defining the high rise elevators H1–H10, will be performed several times a second to select the next high rise elevator to meet with the low rise elevator in a shuttle, and in this embodiment, it will be designated as N. Then, as indicated by the routine 333 in FIG. 24, the shuttle dispatch and/or commit routine of FIG. 4 will be performed, except with the changes indicated in FIG. 25 so as to accommodate in steps **92*a*, 93*a*, 94*a* and 96*a* functions for the high rise elevators which are designated in this embodiment as H and as H(S), similar to the functions 92, 93, 94 and 96 performed for the low rise elevators, which in this embodiment are designated as L and as L(S). Other changes in the routine of FIG. 4 shown in FIG. 25 including taking into account the fact that the one of the local elevators, L or H, which will take the longest to get to the transfer floor should be the one that dispatches the shuttle, if local dispatching of the shuttle is used in the manner described hereinbefore. Thus, if the local elevators will take longer to reach the transfer floor, then the test 98 will determine when dispatching occurs as in FIG. 4. But, if that isn't true, and the high rise local elevator will take longer to reach the shuttle floor, then a test 98*a*** determines when the high rise local is ready and controls the dispatching of the shuttle. As before, if local dispatching of the shuttle is not enabled, then these tests are all bypassed.

Figure 26:
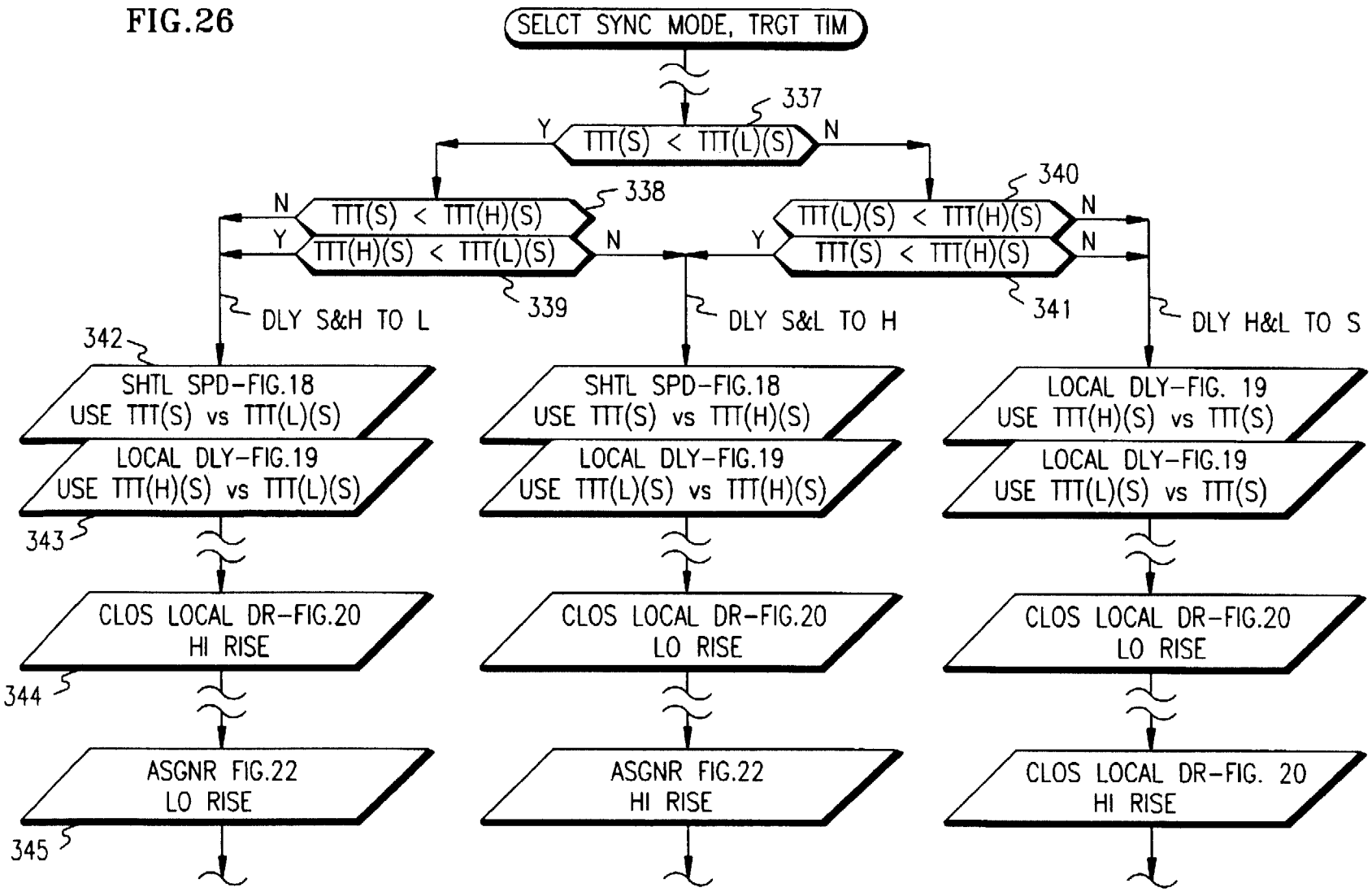
FIG. 26 is a logic flow diagram of a select synch mode, target time subroutine illustrating the determination of the last car predicted to arrive at a transfer floor, to which the other cars are synchronized.

The actual synchronizing of three elevators is, in the present embodiment, deemed to be delaying two of them to match up with another, in the general case, even though the third one may be hastened by means of altering the hall call assignment situation, in the same fashion as described hereinbefore. Therefore, the select synchronizing mode routine of FIG. 10 needs to be more complex than that illustrated hereinbefore. In the present embodiment, the horizontal delay which might be required for one cab to take a longer route than another when that cab has to pass the other, is ignored. However, such may be accommodated utilizing the principles described with respect to FIG. 10 hereinbefore, in any embodiment where desired. In FIG. 26, the steps and tests 104–108, which consider each shuttle in turn, and the transfer points 113, 114, 142 are not shown. However, the principle is the same: that is, each shuttle will be considered, and for each shuttle that has been committed to a local high rise elevator and a local low rise elevator will have the delay considerations accommodated in each pass through FIG. 26.

In FIG. 26, a first test 337 determines if TTT for the shuttle, S, is less than TTT for the low rise, L(S). If it is, a test 338 determines if TTT for the shuttle is also larger than TTT for the high rise, H(S). If not, this defines that the TTT for the low rise must be greater than that of the high rise so a negative result of test 338 is an indication that the shuttle and the high rise should be delayed to suit the low rise. If on the other hand, test 338 is affirmative, then it is not known as to whether the high rise or the low rise has the largest TTT. Therefore, a test 339 determines if the high rise TTT is less than that for the low rise. If it is, an affirmative result is also indicative of the fact that the shuttle and the high rise should be delayed to suit the low rise. But if test 399 is negative this means that the high rise has the longest time 'till transfer and the shuttle in the low rise should be delayed to suit it. In a similar fashion, if test 337 is negative, then a test 340 determines if TTT for the low rise is less than that for the high rise. If it is not, this means that the shuttle has the longest time until the transfer floor, so a negative result of test 340 is indicative of the need to delay the high rise and the low rise to suit the shuttle. On the other hand, if test 340 is affirmative, a test 341 determines if TTT for the shuttle is less than TTT for the high rise. If so, this means that the shuttle and the low rise should be delayed to suit the high rise, the same as a negative result of test 399.

The rest is quite straightforward in view of the teachings hereinbefore. Specifically, if the shuttle and the high rise are to be delayed to suit the time of the low rise, a subroutine 342, which is the Shuttle Speed subroutine of FIG. 18, is performed utilizing TTT of the shuttle as the factor which is to be extended by delay to match that of the low rise. And then as indicated by a subroutine 343, which is the Local Delay subroutine in FIG. 19, using TTT of the high rise to determine adequate delay to match TTT of the low rise. Recall that this is occurring within the routine of FIG. 10, FIG. 18 and FIG. 19 so that these will be performed for this shuttle with its matching low rise and high rise locals, and then a next shuttle in turn will be taken up. If there is an additional committed shuttle, the considerations just described with respect to it may be handled as well. Eventually, when all shuttles have been dealt with, the programming will continue and reach a routine 344 which is the Closed Local Door routine performed for the high rise elevators, as described with respect to FIG. 20, which will result in some delay of the high rise elevator which is matched up with this shuttle. In this case, however, the factors used in step 189 of FIG. 20 to generate a difference value will be TTT of the local minus the TTT of the high rise of the local, TTT(H)(L). Thus it is clear the relationship between the local and the high rise as well as the high rise and the local, and the shuttle and the high rise as well as the shuttle and the local must be maintained in performing this embodiment.

The Closed Local Door routine will also be performed for the low rise in this case, but since it is not to be delayed to suit the other elevators in this case, the result of its test 192 will always be negative since the difference will always be a negative number. Thus no delaying occurs and the performance thereof is not part of the synchronizing in this case.

Figure 27:
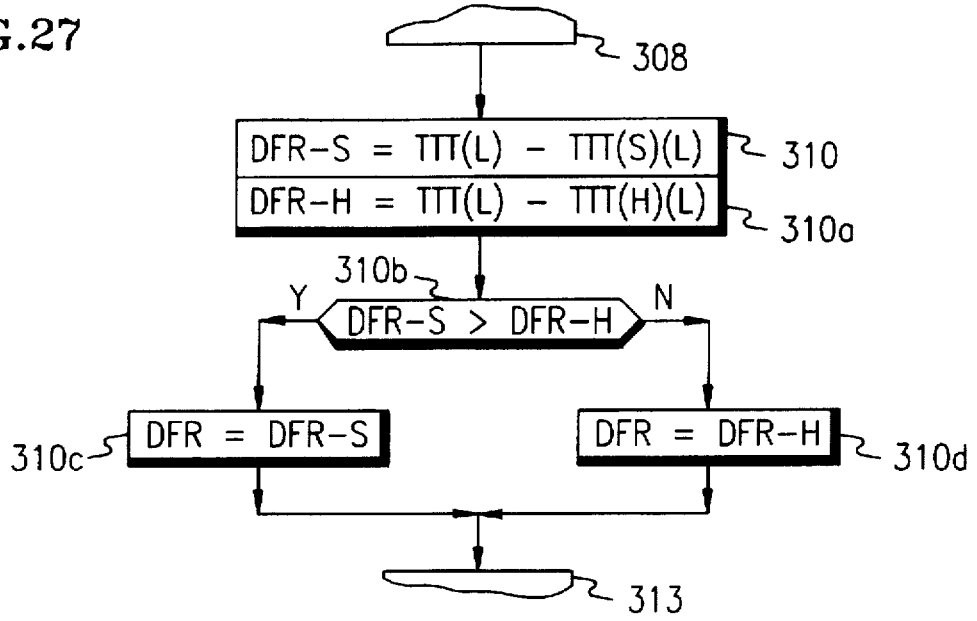
FIG. 27 is a partial logic flow diagram illustrating changes to be made in the routine of FIG. 22 to accommodate synchronizing three elevators in accordance with the present invention.

However, the low rise in this case might be hastened by cancelling or limiting hall calls in a manner described in the portion of the Assignor routine set forth in FIG. 22 as described hereinbefore, illustrated by a routine 345. The only difference, as illustrated in FIG. 27, is first the greatest difference between the local and either the shuttle or the high rise must be determined. Therefore, in addition to the test 310, which in this embodiment will define the difference with respect to the shuttle, there is also a test 310*a* to define the difference with respect to the high rise. Then a test 310*b* determines which difference is greater, and if the shuttle difference is greater, the difference, DFR, is taken to be that of the shuttle in a step 310C; otherwise, the difference is taken to be that of the high rise in a step 310D. The remainder of the hall call assignor routine is the same as described with respect to FIG. 22.

The principles described for synchronizing three elevators may be expanded in a fashion similar to that which has been described. Furthermore, these principles may be used to synchronize the upper elevator of a two elevator shuttle with its lower elevator partner and with one or more local elevators. To have two shuttle elevators synch at the transfer floor 30 while the upper one is later synchronized with the local at the transfer floor 26 only requires slowing the elevator which is sooner-to-arrive at floor 30 to match that of the later one, and then either superposing, on both, additional delay to match the local, or slowing the local with door delays.

Consider now that the shuttle and the local are to be delayed to suit the high rise. In the center of FIG. 26 are illustrated the subroutines and routines which will be modified as just described with respect to delaying the shuttle and the high rise to the low rise, with the low rise and the high rise exchanging places in each instance.

If the situation is such that the high rise and the low rise are delayed to suit the shuttle, then the Local Delay Routine will be performed for both the high rise and the low rise against the TTT of the shuttle, and the Close Local Door routine of FIG. 20 performed for both the low rise group and the high rise group will yield results of delaying doors, either the normal delay, or the last stop delay, or both in certain circumstances.

Figure 28:
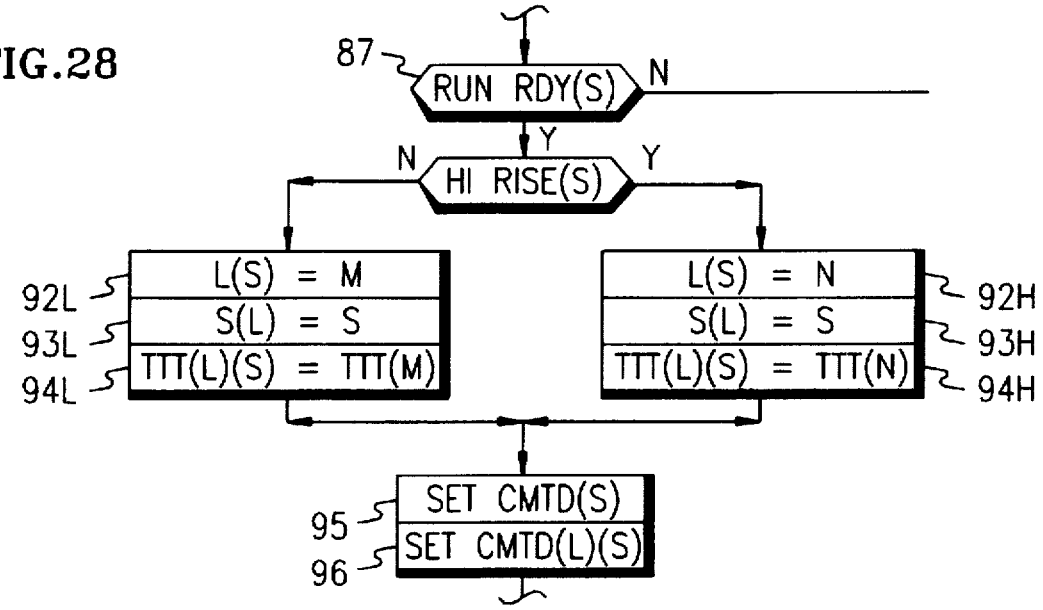
FIG. 28 is a partial logic flow diagram illustrating changes made in the routine of FIG. 4 in order to select a high rise or a low rise elevator in accordance with an embodiment of the invention.

If in FIG. 2 some of the locals (e.g., L1–L5) are high rise and some of the locals (e.g., L6–L10) are low rise, the selection of the next local must be done separately for each group, to provide a next low rise selection, M, and a next high rise selection, N. Each shuttle is designated at the lobby 29 as having its next run be high rise or low rise, and lighted displays 350 adjacent the doors of each shuttle advise the passengers. Then, each shuttle S, in its shuttle Dispatch and/or Commit routine, need only select a high rise or low rise local to commit to, as shown in FIG. 28. All else remains the same. Of course, the odds of having a good match are lower in such a case, since each shuttle must match only one of five, instead of one of ten.

In the embodiment of FIG. 2, for emphasis, it is shown that four shuttles can provide all the vertical service necessary from the low end of the local elevators to a ground or other low lobby floor. In the embodiment of FIG. 23, four shuttles are shown being capable of providing all the service that is necessary for a ten-elevator group of low rise elevators as well as a ten-elevator group of high rise elevators. The reason that four shuttles are adequate for two groups is that each shuttle carries two cabs. Therefore, one cab services the high rise and the other cab services the low rise, thereby reducing the necessity of elevator hoistways in the core at the low end of the building by essentially half. This feature is set forth and claimed in a commonly owned copending U.S. patent application Ser. No. 08/666,188 filed Jun. 19, 1996.

The invention may also be utilized in a case where instead of a low rise and a high rise, a shuttle feeds a low rise and another shuttle, which in turn may feed something else. The foregoing principles are therefore applicable to a plurality of elevators put to a plurality of different uses. The invention as described may be used between shuttle elevators and local elevators, may be used to synchronize elevators that are transferred across a transfer floor 26 on a carrier, or the like, as well as to synchronize elevators that transfer cabs from one elevator directly to the other, as in the case of multi-hoistway shuttles, at transfer floors 21, 30. The invention may be utilized to synchronize multi-hoistway shuttles with other elevators, or single-hoistway shuttles with other elevators. The invention may be utilized to synchronize elevators that utilize off-shaft loading or on-shaft loading with other elevators that similarly may use on-shaft loading, off-shaft loading, or simply transfers to yet other elevator hoistways, either directly, or by means of a carrier or the like. Of course the present invention can be used for purposes other than to synchronize car frames between which elevator cars are to be transferred, and at building levels other than a transfer floor. The invention may accommodate acceleration and deceleration times and distances, and is readily implemented with elevators having different lengths of shafts or different speeds to achieve synchronization at a meeting level. The present invention may use elevator speed as a primary tool or a secondary tool in achieving synchronization. The invention may utilize extended door opening times of elevators making stops to assist in synchronizing elevators, with or without additional synchronization resulting from speed control of that elevator, or another elevator with which it is to be synchronized.

The invention is shown in FIG. 2 as being used with a shuttle elevator which travels between a building level and a lobby floor below such building level in conjunction with local elevators which travel amongst a plurality of floors above that building level. The invention may also be used in a shuttle which carries passengers from a sky lobby down to a building level for distribution among a plurality of floors below that building level by local elevators. The invention may also be used by local elevators feeding the shuttle, as in FIG. 2, which shuttle feeds additional local elevators at the low end thereof. The invention, of course, can be used between pairs of shuttle elevators, as in FIG. 1, or as in the configuration of any of the aforementioned patent applications.

In the embodiment of FIG. 2, a particular shuttle is identified as being the next shuttle in a dispatching sequence for being matched with one of the local cars. The identification of the one of the shuttle cars, or of any other elevator, to be matched with one of the local cars, or any other elevator, can of course be done in any other fashion. The shuttle elevator which is next to be dispatched is the one which needs to be matched up with a local elevator, but in a system in which both the above transfer floor and below transfer floor elevator groups are more random in their operation, other purposes and selection processes, may of course, prevail.

The delaying of one elevator, by controlling motion or doors or otherwise, as well as the hastening of one elevator by controlling hall calls or otherwise, in accordance with the invention, can be utilized to synchronize two or more elevators, in any case.

A system employing the present invention may utilize features set forth in commonly owned U.S. patent applications as follows:

Locking cab to car frame: Ser. No. 8/565,658; Locking carframe to building: Ser. Nos. 08/565,648 and 08/564,024; Transfer of cabs between carframes and carriers: Ser. No. 08/564,704; Elevator motion control logic: Ser. Nos. 08/564,534; 08/564,697; and 08/564,703, all filed on Nov. 29, 2995, and Cab communications and power, Ser. No. 08/630,223 filed on Apr. 10, 1996. Of course, other known features not incompatible with the invention may be used therewith.

All of the aforementioned patent applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A method of synchronizing the arrival, at a given level of a building, of a selected one of a group of elevators operating above said building level with the arrival at said building level of a selected one of a group of elevators operating below said building level, at least one of said groups being a group of local elevators serving a plurality of contiguous levels of said building, each of said elevators operating in response to a motion controller to achieve a determinable motion profile as it traverses a run, comprising:

identifying a first elevator of one of said groups which is to run to said level;

selecting, for relationship with said first elevator in a synchronizing set, a second elevator from another of said groups, which is predicted to be the elevator of said another group, not related to an elevator in a synchronizing set, which will next reach said building level;

defining a committed set of elevators by relating said first elevator with said second elevator;

when each of said elevators has been dispatched on a run, generating for each elevator in said set, as a function of said motion profile and scheduled stops, if any, corresponding to each of said elevators, a time signal representing the time it is predicted that the corresponding elevator will take to reach said building level;

predicting, from said time signals for each elevator of said set, which of said elevators will arrive at said building level before another one of said elevators and which of said elevators will arrive at said building level after another one of said elevators;

delaying one of said set of elevators which is predicted to arrive at said level before another elevator of said set, in a manner to cause said set of elevators to arrive at said building level at more nearly the same time, by alternatively in the event that one of said elevators which is predicted to arrive at said level before another elevator of said set is one selected from a local group, delaying the closing of the elevator door of said one elevator at a stop in a manner related to the difference in the times represented by said time signals; and in the event that one of said elevators which is predicted to arrive at said level before another elevator of said set is one selected from a group other than a local group, controlling the speed of said one elevator in a manner related to the difference in the times represented by said time signals; and hastening the one of said elevators which is predicted to arrive at said building level after another one of said elevators, in a manner to cause said elevators to arrive at said building level at more nearly the same time, by penalizing the assignment of hall calls to said one elevator by an amount related to the difference in time indicated by said time signals.

2. A method of synchronizing the arrival of elevators at a given level of a building comprising:

predicting which of said elevators will arrive at said building level before at least another of said elevators; and altering the operation of one of said elevators in a manner to cause said elevators to arrive at said building level at substantially the same time.

3. A method according to claim 2 wherein said altering step comprises altering the operation of a plurality of said elevators in a manner to cause said elevators to arrive at said building level at substantially the same time.

4. A method of synchronizing the arrival at a given level of a building of an elevator which travels upwardly to said building level with the arrival of an elevator which travels downwardly to said building level, comprising:

predicting which of said elevators will arrive at said level before another of said elevators; and controlling the speed of one of said elevators which is predicted to arrive at said level before another of said elevators, in a manner to cause said elevators to arrive at said building level at more nearly the same time.

5. A method according to claim 4 wherein said step of controlling comprises:

gradually reducing said speed of said one elevator.

6. A method according to claim 4 wherein said step of controlling comprises:

rapidly decelerating said one elevator to a slow speed which is a small fraction of its normal run speed, and causing said one elevator to proceed toward said building level at said slow speed.

7. A method according to claim 4 wherein:

said step of predicting is performed while said one elevator is accelerating from a stop; and said step of controlling comprises limiting said accelerating so that said speed of said one elevator is limited to a run speed less than its normal run speed.

8. A method of synchronizing the arrival at a given level of a building of an elevator which travels upwardly to said building level with the arrival of an elevator which travels downwardly to said building level, comprising:

when each of said elevators has been dispatched on a run, generating for each elevator a time signal representing the time it is predicted that the corresponding elevator will take to reach said building level;

predicting, from said time signals for each elevator, which of said elevators will arrive at said building level before another one of said elevators; and delaying one of said elevators which is predicted to arrive at said level before another one of said elevators by an amount related to the difference between the times represented by said time signals.

9. A method of synchronizing the arrival at a given level of a building of an elevator which travels upwardly to said building level with the arrival of an elevator which travels downwardly to said building level, each of said elevators operating in response to a motion controller to achieve a determinable motion profile as it traverses a run, comprising:

predicting as a function of said motion profile and scheduled stops, if any, corresponding to each of said elevators, one of said elevators which is likely to arrive at said level before another one of said elevators; and delaying said one of said elevators which is predicted to arrive at said level before another one of said elevators, in a manner to cause said elevators to arrive at said building level at more nearly the same time.

10. A method according to claim 9 wherein said one elevator is a local elevator and said step of delaying comprises:

delaying the closing of the elevator door of said one elevator at a stop in a manner to cause said elevators to arrive at said building level at more nearly the same time.

11. A method according to claim 10 wherein said step of delaying further comprises:

controlling the motion of said one car in a manner to cause said elevators to arrive at said building level at more nearly the same time.

12. A method according to claim 9 wherein said step of delaying comprises:

controlling the motion of said one car in a manner to cause said elevators to arrive at said building level at more nearly the same time.

13. A method of synchronizing the arrival at a given level of a building of an elevator which travels upwardly to said building level with the arrival of an elevator which travels downwardly to said building level, comprising:

predicting which of said elevators will arrive at said building level after another one of said elevators; and hastening the one of said elevators which is predicted to arrive at said building level after another one of said elevators, in a manner to cause said elevators to arrive at said building level at more nearly the same time.

14. A method according to claim 13 wherein said step of hastening comprises altering hall calls assigned to said one elevator.

15. A method according to claim 14 wherein said step of hastening comprises cancelling hall calls assigned to said one elevator.

16. A method according to claim 13 wherein:

said predicting step comprises generating a time signal for each of said elevators, each time signal indicative of the time it is predicted that the corresponding elevator will take to reach said building level; and said hastening step comprises penalizing the assignment of hall calls to said one elevator by an amount related to the difference in time indicated by said time signals.

17. A method according to claim 13 further comprising:

predicting which of said elevators will arrive at said building level before another of said elevators; and delaying one of said elevators which is predicted to arrive at said building level before another one of said elevators.

18. A method of synchronizing the arrival, at a given level of a building, of a selected one of a group of elevators operating above said building level with the arrival at said building level of a selected one of a group of elevators operating below said building level, comprising:

selecting a first elevator from one of said groups;

selecting a second elevator from the other of said groups;

defining a committed set of elevators by relating said first elevator with said second elevator;

predicting which one of said set of elevators will arrive at said level before another elevator of said set; and delaying the one of said set of elevators which is predicted to arrive at said level before another elevator of said set, in a manner to cause said set of elevators to arrive at said building level at more nearly the same time.

19. A method according to claim 18 wherein:

one of said elevators is selected on the basis of being the next elevator in its corresponding one of said groups which will begin a run toward said building level.

20. A method according to claim 19 wherein:

the other of said elevators is selected as the one in its related one of said groups, not related to another elevator in a set, that is predicted to be the first one of said related group which will reach said level.

21. A method according to claim 18 wherein:

one of said elevators is selected as the one in its related one of said groups, not related to another elevator in a set, that is predicted to be the first one of said related groups which will reach said level.

22. A method according to claim 18 further comprising:

predicting which one of said set of elevators will arrive at said building level after another elevator of said set; and hastening the one of said set of elevators which is predicted to arrive at said building level after another one of said elevators, in a manner to cause said elevators to arrive at said building level at more nearly the same time.

23. A method of synchronizing the arrival, at a given level of a building, of a selected one of a group of elevators operating above said building level with the arrival at said building level of a selected one of a group of elevators operating below said building level, at least one of said groups being a group of local elevators serving a plurality of contiguous levels of said building, comprising:

selecting a first elevator from one of said groups;

selecting a second elevator from another of said groups;

defining a set of elevators by relating said first elevator with said second elevator;

predicting which one of said set of elevators will arrive at said level before another elevator of said set; and in the event that the one of said elevators which is predicted to arrive at said level before another elevator of said set is one selected from a local group, delaying the closing of the elevator door of said one elevator at a stop in a manner to cause said pair of elevators to arrive at said building level at more nearly the same time.

24. A method according to claim 23 wherein:

in the event that the one of said elevators which is predicted to arrive at said level before another elevator of said set is one selected from a group other than a local group, controlling the speed of said one elevator in a manner to cause said elevators to arrive at said level at more nearly the same time.

25. A method according to claim 23 wherein said predicting step comprises:

when each elevator of said set has been dispatched on a run, generating for each elevator a time signal representing the time it is predicted that the corresponding elevator will take to reach said building level; and selecting, in response to said time signals for all elevators of said set, said one of said set of elevators which will arrive at said building level before another elevator of said set;

and wherein said delaying step comprises:

determining the number of stops that said one car will make before reaching said building level;

dividing the time represented by said time signal for said one elevator by said number of stops to provide a door delay signal indicative thereof; and delaying the door of said one elevator at each of said stops by the amount of time indicated by said door delay signal.

26. A method according to claim 23 further comprising the step of:

determining when said one elevator is at its last stop before reaching said level and delaying the closing of the door of said one elevator at said last stop until the time estimated for said one elevator to reach said building level is substantially the same as the time estimated for said another elevator to reach said building level.

27. A method of synchronizing the arrival, at a given level of a building, of a selected one of a group of elevators operating above said building level with the arrival at said building level of a selected one of a group of elevators operating below said building level, comprising:

identifying a first elevator of one of said groups which is to run to said level;

selecting, for relationship with said first elevator in a synchronizing set, a second elevator from another of said groups, which is predicted to be the elevator of said another group, not related to an elevator in a synchronizing set, which will next reach said building level; and controlling the operation of said elevators in a manner to cause said elevators to arrive at said building level at substantially the same time.

* * * * *